US011328921B2

(12) United States Patent
Ueda et al.

(10) Patent No.: US 11,328,921 B2
(45) Date of Patent: May 10, 2022

(54) QUADRUPOLE MASS FILTER AND ANALYTICAL DEVICE

(71) Applicant: SHIMADZU CORPORATION, Kyoto (JP)

(72) Inventors: Manabu Ueda, Kyoto (JP); Shinjiro Fujita, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 17/059,683

(22) PCT Filed: Jun. 1, 2018

(86) PCT No.: PCT/JP2018/021285
§ 371 (c)(1),
(2) Date: Nov. 30, 2020

(87) PCT Pub. No.: WO2019/230001
PCT Pub. Date: Dec. 5, 2019

(65) Prior Publication Data
US 2021/0210333 A1 Jul. 8, 2021

(51) Int. Cl.
*H01J 49/42* (2006.01)

(52) U.S. Cl.
CPC ..... *H01J 49/4215* (2013.01)

(58) Field of Classification Search
CPC ..... H01J 49/4215
See application file for complete search history.

(56) References Cited

U.S. PATENT DOCUMENTS

| | | | |
|---|---|---|---|
| 5,459,315 | A | 10/1995 | Waki |
| 8,278,618 | B2 | 10/2012 | Makarov et al. |
| 2016/0118235 | A1 | 4/2016 | Fujita |

FOREIGN PATENT DOCUMENTS

| | | | |
|---|---|---|---|
| JP | 03-285246 | A | 12/1991 |
| JP | 7-142026 | A | 6/1995 |
| JP | 6004098 | B2 | 10/2016 |

OTHER PUBLICATIONS

Written Opinion for PCT/JP2018/021285, dated Aug. 28, 2018.
International Search Report for PCT/JP2018/021285, dated Aug. 28, 2018.

*Primary Examiner* — Nicole M Ippolito
*Assistant Examiner* — Hanway Chang
(74) *Attorney, Agent, or Firm* — Sughrue Mion, PLLC

(57) ABSTRACT

A quadrupole mass filter includes: four electrodes arranged to surround a central axis and constituting a quadrupole; attachment portions to which a plurality of electrical conductors are attached, at least one of the electrical conductors being arranged at a position that lies in a direction toward an area between each of the adjacent electrodes among the four electrodes, as viewed from the central axis; and a holder having a hollow portion and holding the four electrodes and the plurality of electrical conductors, wherein the electrical conductors are attached to the respective attachment portions and held by the holder with elasticity of a material constituting the electrical conductors.

11 Claims, 13 Drawing Sheets

QUADRUPOLE MASS FILTER AND ANALYTICAL DEVICE

CROSS REFERENCE TO RELATED APPLICATIONS

This application is a National Stage of International Application No. PCT/JP2018/021285 filed Jun. 1, 2018.

TECHNICAL FIELD

The present invention relates to a quadrupole mass filter and an analytical device.

BACKGROUND ART

In a quadrupole mass spectrometer, ionized samples are subjected to mass separation with a quadrupole mass filter. The quadrupole mass filter separates ions by selectively passing the ions therethrough based on their m/z (mass-to-charge ratio). The collision of ions with an insulating structure or the like which constitutes the quadrupole mass filter changes an electric field inside the quadrupole mass filter due to, for example, the charging of the insulating structure. This change causes, for example, reduction in separation performance of the quadrupole mass filter and reduction in the amount of ions passed through the quadrupole mass filter and detected, which are problematic (see PTL 1).

To address this problem, a conductive material is arranged at a predetermined position of the quadrupole mass filter, and ions are caused to collide with the conductive material, thereby avoiding the charging of the quadrupole mass filter.

FIGS. 13(A), 13(B), and 13(C) are conceptual diagrams illustrating a configuration of a typical quadrupole mass filter 9. FIG. 13(A) is a front view. FIGS. 13(B) and 13(C) are side views as viewed from an arrow A10 and arrow A20 of FIG. 13(A), respectively. The setting of the coordinate system is the same as in FIG. 1, which will be described later.

The typical quadrupole mass filter 9 includes: a quadrupole consisting of a rod-shaped electrodes 11*a*, 11*b*, 11*c*, and 11*d*; and rod-shaped conductive materials 3*a*, 3*b*, 3*c*, and 3*d*. The electrodes 11*a*, 11*b*, 11*c*, and 11*d* and the conductive materials 3*a*, 3*b*, 3*c*, and 3*d* are arranged around the central axis Ax of the quadrupole mass filter in almost parallel with the central axis Ax, and are held by a holder 20.

CITATION LIST

Patent Literature

PTL1: Japanese Patent No. 6004098

SUMMARY OF INVENTION

Technical Problem

However, the typical quadrupole mass filter is required to satisfy the condition where the conductive materials are desirably placed away from the central axis of the quadrupole mass filter, in order to avoid the influence of the arranged conductive materials themselves on the electric field, and thus it has been difficult to attach the conductive materials to the quadrupole mass filter.

Solution to Problem

According to the 1st aspect of the present invention, a quadrupole mass filter comprises: four electrodes arranged to surround a central axis and constituting a quadrupole; attachment portions to which a plurality of electrical conductors are attached, at least one of the electrical conductors being arranged at a position that lies in a direction toward an area between each of the adjacent electrodes among the four electrodes, as viewed from the central axis; and a holder having a hollow portion and holding the four electrodes and the plurality of electrical conductors, wherein the electrical conductors are attached to the respective attachment portions and held by the holder with elasticity of a material constituting the electrical conductors.

According to the 2nd aspect of the present invention, in the quadrupole mass filter according to the 1st aspect, it is preferred that the attachment portions are formed in the inner peripheral surface facing the hollow portion of the holder to have a recess shape formed by depressing the inner peripheral surface away from the central axis.

According to the 3rd aspect of the present invention, in the quadrupole mass filter according to the 2nd aspect, it is preferred that the recess shape in each of the attachment portions is a groove formed in the inner peripheral surface of the hollow portion along the central axis.

According to the 4th aspect of the present invention, in the quadrupole mass filter according to any one of the 1st to 3rd aspects, it is preferred that at least portions of the plurality of electrical conductors are connected to and integral with each other by a support.

According to the 5th aspect of the present invention, in the quadrupole mass filter according to any one of the 1st to 3rd aspects, it is preferred that each of the plurality of electrical conductors includes a clip mechanism integral therewith and is clipped to each of the attachment portions by the clip mechanism, and held by the holder.

According to the 6th aspect of the present invention, it is preferred that the quadrupole mass filter according to any one of the 1st to 5th aspects further comprises: wiring for grounding the electrical conductors or applying a voltage to the electrical conductors.

According to the 7th aspect of the present invention, in the quadrupole mass filter according to any one of the 1st to 6th aspects, it is preferred that the attachment portions are arranged at respective positions at which the electrical conductors are at zero potential when respective voltages having the same magnitude and different polarities are applied to the adjacent electrodes.

According to the 8th aspect of the present invention, in the quadrupole mass filter according to any one of the 1st to 7th aspects, it is preferred that a distance from the central axis to a closest point on the plurality of electrical conductors arranged in the respective attachment portions to the central axis is longer than a distance from the central axis to a closest point on the four electrodes to the central axis.

According to the 9th aspect of the present invention, an analytical device comprises the quadrupole mass filter according to any one of the 1st to 8th aspects.

According to the 10th aspect of the present invention, in the analytical device according to the 9th aspect, it is preferred that the electrical conductors are grounded.

According to the 11th aspect of the present invention, it is preferred that the analytical device according to the 9th aspect further comprises a voltage applicator that applies a voltage to the electrical conductors.

According to the 12th aspect of the present invention, it is preferred that the analytical device according to 11th aspect further comprises a detector that detects ions passed through the quadrupole mass filter, wherein the voltage applicator applies a voltage having a polarity which is the same as or different from that of the ions to the electrical conductors during a measurement preparation period between a first measurement period when the detector detects a first analyte and a second measurement period when the detector detects a second analyte, the measurement preparation period being when no measurement is performed.

Advantageous Effects of Invention

In the present invention, an electrical conductor is easily attached to the quadrupole mass filter to avoid charging of the quadrupole mass filter.

BRIEF DESCRIPTION OF DRAWINGS

FIG. 1(A) is a front view, and FIGS. 1(B) and 1(C) are side views.

FIG. 3(A) is a front view, and FIG. 3(B) is a Q-Q cross-sectional view.

FIGS. 10(A) and 10(B) are side views, and FIG. 10(C) is a perspective view.

FIG. 13(A) is a front view, and FIGS. 13(B) and 13(C) are side views.

DESCRIPTION OF EMBODIMENTS

The embodiments of the present invention will be described below with reference to the drawings.

First Embodiment

Figure 1A:
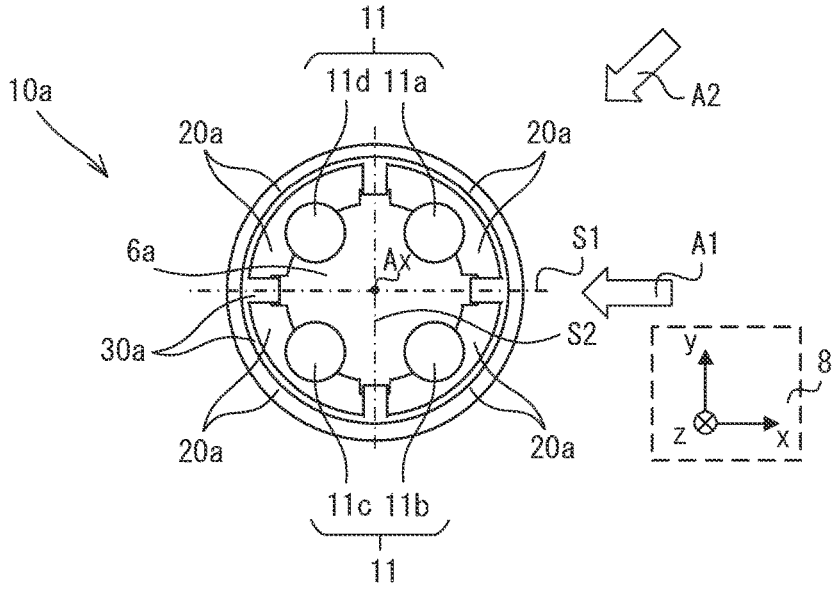
FIGS. 1(A), 1(B), and 1(C) are conceptual diagrams illustrating a configuration of a quadrupole mass filter according to an embodiment.
Figure 1B:
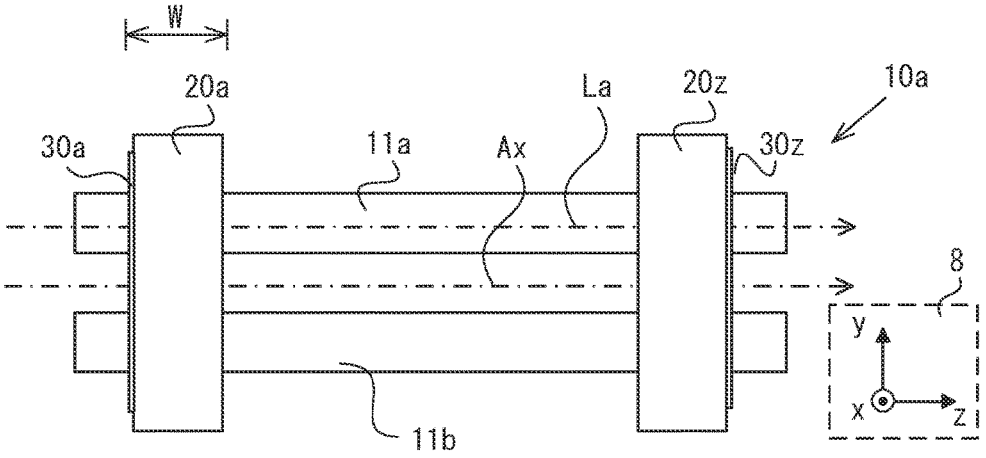
Figure 1C:
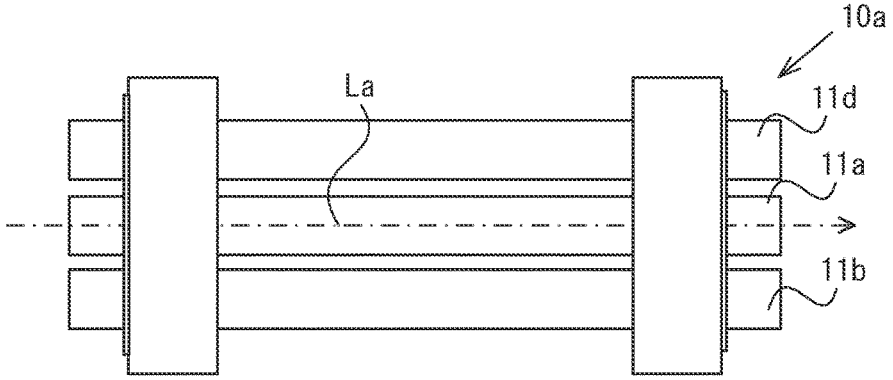
Figure 2A:
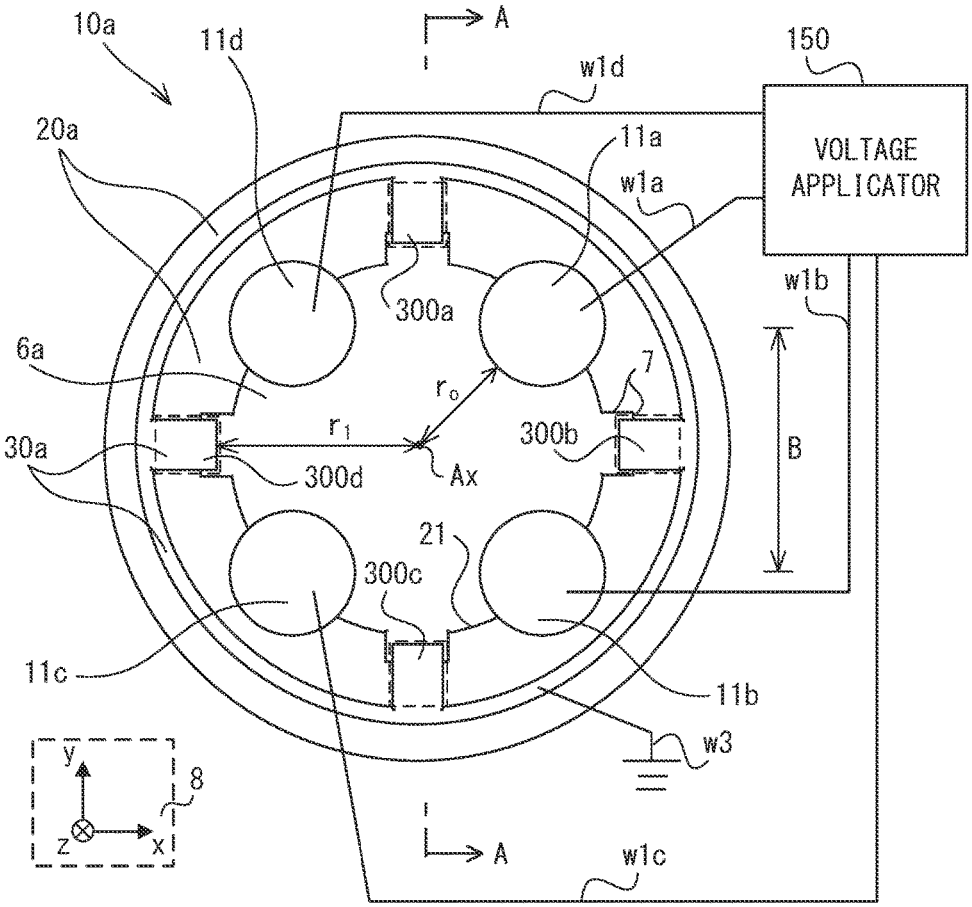
FIG. 2(A) is a schematic front view of a configuration of the quadrupole mass filter of the embodiment.
Figure 2B:
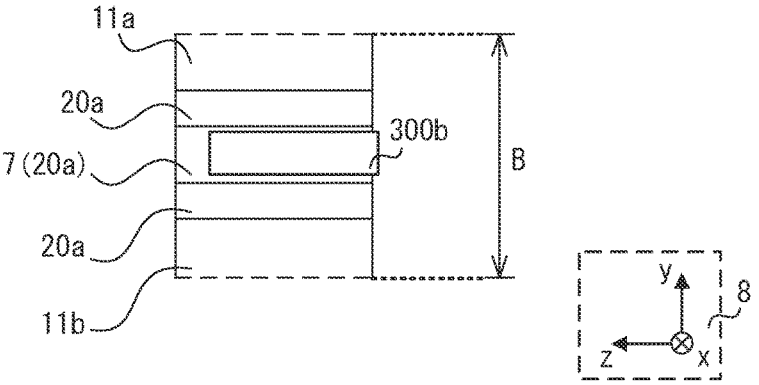
FIG. 2(B) is a A-A cross-sectional view of FIG. 2(A).

FIGS. 1(A), 1(B), and 1(C) are conceptual diagrams illustrating a shape of a quadrupole mass filter 10*a* according to the present embodiment. FIG. 1(A) is a front view of the quadrupole mass filter 10*a* viewed along the center axis direction. FIGS. 1(B) and 1(C) are side views of the quadrupole mass filter 10*a* as viewed from arrows A1 and A2 of FIG. 1(A), respectively. FIG. 2(A) is an enlarged view of FIG. 1(A) schematically illustrating the quadrupole mass filter 10*a*. FIG. 2(B) is a view taken along line A-A of an area indicated by B of FIG. 2(A) in an area indicated by W of FIG. 1(B).

The quadrupole mass filter 10*a* includes: four electrodes 11*a*, 11*b*, 11*c*, and 11*d* (hereinafter referred to as electrodes 11 if each of the electrodes is referred to without distinction); holders 20*a* and 20*z* for holding the four electrodes 11 at both ends in the longitudinal direction thereof; and conductive structures 30*a* and 30*z* (see FIGS. 1(A) and 1(B)). The holder 20 has a hollow portion 6*a*. The conductive structure 30*a* includes four electrical conductors 300*a*, 300*b*, 300*c*, and 300*d* (see FIG. 2(A), hereinafter referred to as conductive materials 300 if each of the electrodes is referred to without distinction). The holder 20*z* and the conductive structure 30*z* have the same structures as the holder 20*a* and the conductive structure 30*a*, respectively, and are arranged inversely relative to the z-axis. The description of the holder 20*z* and the conductive structure 30*z* having the same structures as the holder 2*ab* and the conductive structure 30*a*, respectively, are omitted, as appropriate.

In the following embodiment, as shown in coordinate axis 8, the z-axis is taken in the direction of the central axis Ax, and two axes orthogonal to the x-axis are the x-axis and y-axis. The y-axis extends along the line of intersection of the plane that is perpendicular to the z-axis and the plane that divides the quadrupole mass filter into two plane-symmetric portions of a portion having the electrodes 11*a* and 11*b* and a portion having the electrodes 11*c* and 11*d*.

The four electrodes 11*a*, 11*b*, 11*c*, and 11*d* contain a conducting material such as a metal, are arranged to surround the central axis Ax, and constitutes a quadrupole. The four electrodes 11*a*, 11*b*, 11*c*, and 11*d* are arranged at respective positions to be four-fold symmetrical with the central axis Ax serving as a rotation axis. The radius of the inscribed circle is represented by $r_o$ which corresponds to the distance from the central axis Ax to the position closest to the central axis Ax on the electrode 11 (see FIG. 2(A)).

Each of the electrodes 11*a*, 11*b*, 11*c*, and 11*d* has a rod shape with the width along the z-axis higher than the widths along the x and y axes. The electrodes 11*a*, 11*b*, 11*c*, and 11*d* are arranged such that these long axes are substantially parallel with the z-axis (see FIG. 1(B)). FIGS. 1(B) and 1(C) show only a long axis La of the electrode 11*a* among the four electrodes 11.

The electrodes 11*a*, 11*b*, 11*c*, and 11*d* are in contact with the inner peripheral surface 21 facing the hollow portion 6*a* of the holder 20*a*, and are fixed to the holder 20*a* made from an insulating material such as ceramics via a connection fitting such as screw (not shown) (see FIG. 2(A)). Each of the electrodes 11*a*, 11*b*, 11*c*, and 11*d* has a circular cross section perpendicular to its long axis. Corresponding to this circular shape, the respective portions of the inner peripheral surface 21 of the holder 20*a*, facing the electrodes 11*a*, 11*b*, 11*c*, and 11*d* are in an arc shape.

It should be noted that the cross-sectional shape of each of the electrodes 11*a*, 11*b*, 11*c*, and 11*d* is not limited to particular shapes as long as ions are separated based on the value of m/z, and may be, for example, a hyperbolic shape.

The electrodes 11*a*, 11*b*, 11*c*, and 11*d* are electrically connected to a voltage applicator 150 (see FIG. 2(A)). The voltage applicator 150 applies a controlled predetermined voltage to the electrodes 11*a*, 11*b*, 11*c*, and 11*d*. In FIG.

2(A), the wiring connecting between the voltage applicator 150 and the electrodes 11*a*, 11*b*, 11*c*, and 11*d* are schematically shown by polygonal lines w1*a*, w1*b*, w1*c*, and w1*d*.

The quadrupole mass filter 10*a* brings the ions entering the hollow portion 6*a* of the holder 20*a* to selectively pass therethrough based on values of m/z of the ions. The quadrupole mass filter 10*a* allows ions having a desired value of m/z to pass therethrough by electromagnetic action induced by voltages applied from the voltage applicator 150 to the electrodes 11.

The voltage applicator 150 includes a power source capable of applying a direct-current voltage and an alternating-current voltage. The voltage applicator 150 applies a voltage obtained by superimposing the direct-current voltage and the alternating-current voltage to the electrodes 11. Assuming that the voltage applied to a pair of electrodes 11*a* and 11*c* facing each other by the voltage applicator 150 is Va, and the voltage applied to a pair of electrodes 11*b* and 11*d* facing each other by the voltage applicator 150 is Vb, the voltages Va and Vb at time t are represented by, for example, the following equation (1).

$$Va=U+V\cos\omega t$$

$$Vb=-(U+V\cos\omega t) \quad (1)$$

In the equation (1), U represents a value of a direct-current voltage, V represents an amplitude of an alternating-current voltage, and ω represents a frequency of the alternating-current voltage. The voltage applicator 150 applies the respective voltages having the same magnitude and different polarities, to a pair of the electrodes 11*a* and 11*c* facing each other and to other pair of the electrodes 11*b* and 11*d* facing each other.

The ionic motion in an area surrounded by the electrodes 11*a*, 11*b*, 11*c*, and 11*d* is calculated based on the Mathieu equation represented by the following equation (2).

$$m_i(d^2x/dt^2)=-(2zex/r_o^2)(U-V\cos\omega t)$$

$$m_i(d^2y/dt^2)=-(2zey/r_o^2)(U-V\cos\omega t) \quad (2)$$

In the equation (2), $m_i$ represents the ion mass, and e represents the charge amount of the ion. This Mathieu equation determines the condition of the voltage at which ions with the desired m/z stably pass through the area surrounded by the electrodes 11, and the range of m/z of ions that stably pass through the area when the predetermined voltage is applied, for example. A voltage applied to the electrodes 11 is set based on the value of m/z of ions to be separated, and the degree of selectivity required for m/z as appropriate.

Ions which cannot stably pass through the area surrounded by the electrodes 11 deviate from the central axis Ax, and some of the ions adhere to the holder 20*a* or the insulating material such as foreign matters adhered to the surfaces of the electrodes 11 to cause charging. This charging disturbs the electric field in the area surrounded by the electrodes 11. In order to reduce or eliminate such disturbance of the electric field, electrical conductors 300 are arranged on the inner peripheral surface 21 of the holder 20*a*.

Four electrical conductors 300*a*, 300*b*, 300*c*, and 300*d* are formed from a conducting material such as a metal, and are arranged to surround a central axis Ax (see FIG. 2(A)). The four electrical conductors 300*a*, 300*b*, 300*c*, and 300*d* are arranged at respective positions to be four-fold symmetrical with the central axis Ax serving as a rotation axis. The radius of the inscribed circle is represented by $r_1$ which corresponds to the distance from the central axis Ax up to the closest position on the electrical conductors 300 to the central axis Ax. The distance $r_1$ from the central axis Ax to up to the closest position on the electrical conductor 300 to the central axis Ax is preferably longer than the distance $r_o$ from the central axis Ax to the closest position on the electrode 11 to the central axis Ax. This allows the influence of the electrical conductors 300 themselves on the electric field in the area surrounded by the electrodes 11 to be reduced.

An electrical conductor 300*a* is arranged at a position along a direction from the central axis Ax toward an area between the adjacent electrodes 11*d* and 11*a*. An electrical conductor 300*b* is arranged at a position along a direction from the central axis Ax toward an area between the adjacent electrodes 11*a* and 11*b*. An electrical conductor 300*c* is arranged at a position along a direction from the central axis Ax toward an area between the adjacent electrodes 11*b* and 11*c*. An electrical conductor 300*d* is arranged at a position along a direction from the central axis Ax toward an area between the adjacent electrodes 11*c* and 11*d*.

As described above, each of the four electrical conductors 300*a*, 300*b*, 300*c*, and 300*d* is arranged between adjacent electrodes among the four electrodes 11 as viewed from the central axis Ax. In other words, the electrical conductors 300*a*, 300*b*, 300*c*, and 300*d* are arranged at respective positions in radial directions in which the electrodes 11*a*, 11*b*, 11*c*, and 11*d* are not arranged, with the central axis Ax serving as a rotation axis.

The electrical conductor 300*a* is arranged between the electrodes 11*d* and 11*a* adjacent to each other along the inner peripheral surface 21 of the holder 20*a*. The electrical conductor 300*b* is arranged between the electrodes 11*a* and 11*b* adjacent to each other along the inner peripheral surface 21 of the holder 20*a*. The electrical conductor 300*c* is arranged between the electrodes 11*b* and 11*c* adjacent to each other along the inner peripheral surface 21. The electrical conductor 300*d* is arranged between the electrodes 11*c* and 11*d* adjacent to each other along the inner peripheral surface 21 of the holder 20*a*. In this manner, each of the four electrical conductors 300*a*, 300*b*, 300*c*, and 300*d* is arranged between a pair of adjacent electrodes among the four electrodes 11 adjacent to each other along the inner peripheral surface 21.

As shown in FIG. 2(B), the electrical conductor 300*b* is configured such that as viewed from a side of hollow portion 6*a* relative to holder 20*a*, its plate-like portion having electrical conductivity is arranged along the attachment portion 7 which is a groove-like recess formed in the inner peripheral surface 21 of the holder 20*a*. The same applies to the electrical conductors 300*a*, 300*b*, and 300*d*. This configuration allows the recess shape or the groove shape of the attachment portion 7 to be used, and allows the electrical conductors 300 to be easily positioned in the holder 20*a*.

Figure 3A:
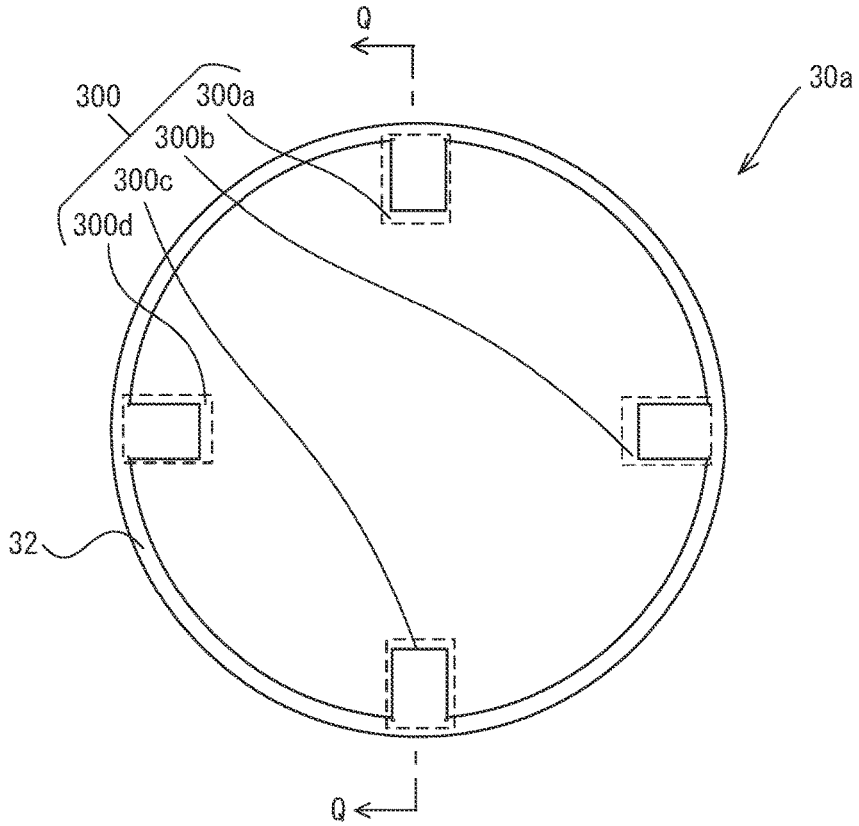
FIGS. 3(A) and 3(B) are conceptual diagrams illustrating a configuration of an electrical conductor.
Figure 3B:
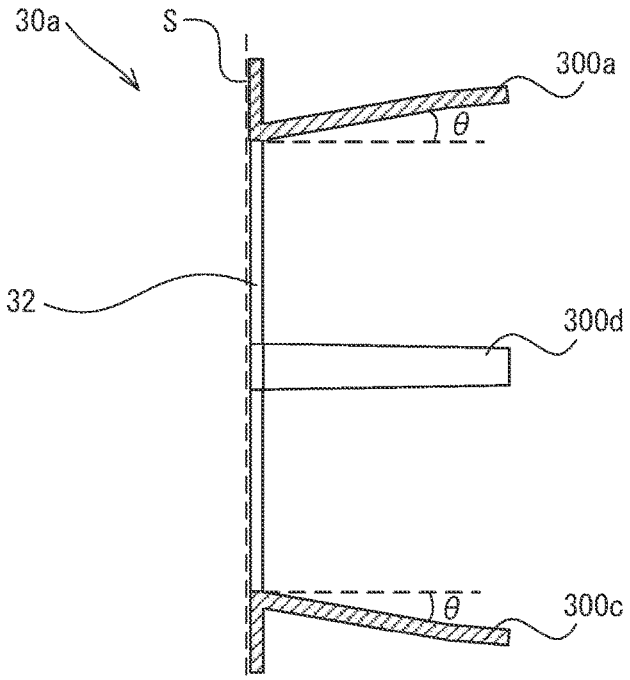

FIGS. 3(A) and 3(B) are conceptual diagrams illustrating the shape of a part constituting the conductive structure 30*a*. FIG. 3(A) is a front view, and FIG. 3(B) is a Q-Q cross-sectional view of FIG. 3(A). The conductive structure 30*a* includes four electrical conductors 300*a*, 300*b*, 300*c*, and 300*d* and an annular portion 32 which is a support linking and integrally supporting these electrical conductors 300. The annular portion 32 contains a conducting material such as a metal, and is electrically connected to the electrical conductors 300*a*, 300*b*, 300*c*, and 300*d*. When the conductive structure 30*a* is arranged on the ion-entering surface of the holder 20*a*, ions can enter the annular portion 32 having conductivity, thereby allowing reduction in charging of the holder 20. This arrangement is particularly preferable.

It should be noted that the shape of the support for the electrical conductors 300 is not limited to particular shapes, and may be, for example, a shape corresponding to the shape of the holder 20*a*, as appropriate.

In the conductive structure 30*a*, the electrical conductors 300*a*, 300*b*, 300*c*, and 300*d* are formed to extend along the direction tilted radially, by θ, from the direction perpendicular to the plane S that extends along the annular portion 32. With the conductive structure 30*a* arranged in the holder 20*a*, the angle between the electrical conductors 300*a*, 300*b*, 300*c*, and 300*d* and the plane that extends along the annular portion 32 becomes substantially 90° by the normal force from the inner peripheral surface 21 of the holder 20*a*. This normal force matches the elastomeric force caused by deformation of the conducting material such as a metal constituting the electrical conductors 300 by the angle θ. By the static frictional force caused by this match, the electrical conductors 300 are fixed to the holder 20*a*. Specifically, the electrical conductors 300 are attached to the respective attachment portions 7 and held by the holder 20*a* with elasticity of the material constituting the electrical conductors 300.

Figure 4A:
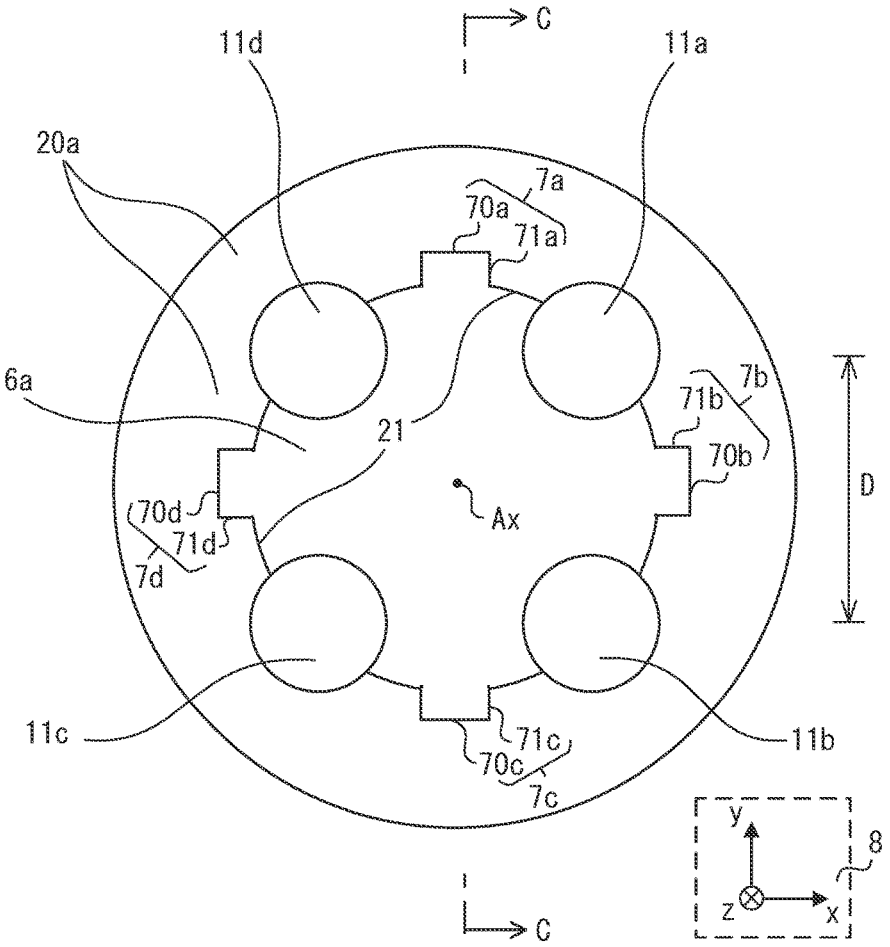
FIG. 4(A) is a schematic front view of the quadrupole mass filter, illustrating configurations of a quadrupole and a holder.
Figure 4B:
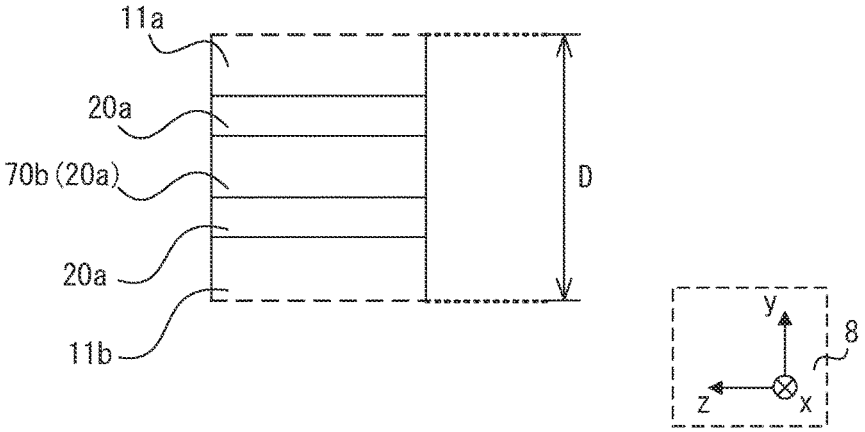
FIG. 4(B) is a C-C cross-sectional view of FIG. 4(A).

FIGS. 4(A) and 4(B) are conceptual diagrams illustrating electrodes 11 and a holder 20*a* in which a conductive structure 30*a* is not arranged. FIG. 4(A) is a front view. FIG. 4(B) is a view taken along line C-C of an area shown by D of FIG. 4(A) in an area shown by W of FIG. 1(B). The four attachment portions 7*a*, 7*b*, 7*c*, and 7*d* are arranged at respective positions to be four-fold symmetrical with the central axis Ax serving as a rotation axis. The attachment portions 7*a*, 7*b*, 7*c*, and 7*d* are groove-like recesses formed in the inner peripheral surface 21, and includes bottom portions 70*a*, 70*b*, 70*c*, and 70*d*, respectively, and inner side surfaces 71*a*, 71*b*, 71*c*, and 71*d*, respectively.

As shown in FIG. 4(B), the bottom portion 70*b* is formed to face the hollow portion 6*a*, and the attachment portion 7*b* is a groove-like portion extending in the z-axis direction along the central axis Ax and has the bottom portion 70*b* as a bottom surface. As mentioned above, the electrical conductor 300*b* is arranged along the bottom portion 70*b*. The same applies to the attachment portions 7*a*, 7*b*, and 7*d*.

The quadrupole mass filter 10*a* includes wiring for grounding the electrical conductors 300*a*, 300*b*, 300*c*, and 300*d*, which are electrically grounded by the wiring. In the quadrupole mass filter 10*a* according to the present embodiment, the electrical conductors 300*a*, 300*b*, 300*c*, and 300*d* are electrically connected to each other as a conductive structure 30*a*. In FIG. 2(A), the electrical grounding of the conductive structure 30*a* is schematically shown by a polygonal line w3.

As mentioned above, when the voltage applicator 150 applies the respective voltages having the same magnitude and different polarities, to a pair of the electrodes 11*a* and 11*c* facing each other and to other pair of the electrodes 11*b* and 11*d* facing each other, a plane with a zero potential is formed between adjacent electrodes 11 to be substantially parallel with the z-axis. In FIG. 1(A), a zero-potential plane S1 formed between the electrodes 11*a* and 11*b* and between the electrodes 11*c* and 11*d*, and a zero-potential plane S2 formed between the electrodes 11*d* and 11*a* and between the electrodes 11*b* and 11*c* are schematically shown by dashed-dotted lines.

In order not to disturb the electric field of the area surrounded by the electrodes 11, the electrical conductors 300 whose potential becomes zero when grounded are preferably arranged at respective positions at which the zero potential is achieved when the voltage applicator 150 applies a voltage to the electrodes 11 for separation of ions according to the values of m/z. In the quadrupole mass filter 10*a* according to the present embodiment, the conductive materials 300*b* and 300*d* are arranged to include a part of the zero-potential plane S1, and the conductive materials 300*a* and 300*c* are arranged to include a part of the zero potential plane S2.

The quadrupole mass filter 10*a* may be used as a mass separation unit in an analytical device for analyzing ions or a part of the mass separation unit. Such an analytical device includes, in addition to a single quadrupole mass spectrometer and a tandem quadrupole mass spectrometer, any devices to which a quadrupole mass filter is applied such as a device where a quadrupole mass filter is combined with a chromatograph such as gas chromatograph or liquid chromatograph, an ionic mobility analyzer or the like.

By the embodiment, the following actions and effects can be obtained.

(1) The quadrupole mass filter 10*a* according to the present embodiment includes: four electrodes 11*a*, 11*b*, 11*c*, and 11*d* arranged to surround the central axis Ax and constituting a quadrupole; attachment portions 7 to which a plurality of electrical conductors 300*a*, 300*b*, 300*c*, and 300*d* are attached, at least one of the electrical conductors 300*a*, 300*b*, 300*c*, and 300*d* being arranged between each of the adjacent electrodes among the four electrodes 11*a*, 11*b*, 11*c*, and 11*d*, as viewed from the central axis Ax; and a holder 20*a* having a hollow portion 6*a* and holding the four electrodes 11 and the plurality of electrical conductors 300, and the electrical conductors 300 are attached to the respective attachment portions 7 and held by the holder 20*a* with elasticity of the material constituting the electrical conductors 300. This configuration does not necessarily require operations such as screwing when the electrical conductor 300 is attached, and allows the quadrupole mass filter 10*a* to be assembled and maintained rapidly.

(2) In the quadrupole mass filter 10*a* according to the present embodiment, the attachment portions 7 are formed in the inner peripheral surface 21 facing the hollow portion 6*a* of the holder 20*a* to have a recess shape formed by depressing the inner peripheral surface 21 away from the central axis Ax. This configuration allows the approximate position of the electrical conductor 300 to be determined using the recess shape of the attachment portion 7 when the electrical conductor 300 is attached to the quadrupole mass filter 10*a*. This determination allows the quadrupole mass filter 10*a* to be assembled or maintained rapidly.

(3) In the quadrupole mass filter 10*a* according to the present embodiment, the recess shape of the attachment portion 7 is formed as a groove in the inner peripheral surface 21 of the hollow portion 6*a* along the central axis. This configuration allows the accurate position of the electrical conductor 300 to be determined using the rectangular groove of the attachment portion 7 when the electrical conductor 300 is attached to the quadrupole mass filter 10*a*. This attachment allows the quadrupole mass filter 10*a* to be assembled or maintained more rapidly.

(4) In the quadrupole mass filter 10*a* according to the present embodiment, at least portions of the plurality of electrical conductors 300 are linked and integral with each other by an annular portion 32 which is a support. With this configuration, the electrical conductors 300*a*, 300*b*, 300*c*, and 300*d* are attached at a time. This attachment at a time allows the quadrupole mass filter 10*a* to be assembled or maintained more rapidly.

(5) The quadrupole mass filter 10*a* according to the present embodiment includes wiring for grounding the electrical conductors 300. This wiring allows the influence of the ions entering the electrical conductors 300 on the electric field in the area surrounded by the electrodes 11 to be reduced or eliminated when the ions pass through the quadrupole mass filter 10*a*.

(6) In the quadrupole mass filter 10*a* according to the present embodiment, the attachment portion 7 is arranged at a position at which the electrical conductor 300 is at zero potential when respective voltages having the same magnitude and different polarities are applied to the adjacent electrodes 11. This configuration avoids a rapid change in electric field in the area surrounded by the electrodes 11, and allows the influence of the electrical conductor 300 on the electric field in the area to be reduced or eliminated.

(7) In the quadrupole mass filter 10*a* according to the present embodiment, the distance $r_o$ from the central axis Ax to the closest point on the four electrodes 11 to the central axis Ax is longer than the distance $r_1$ from the central axis Ax to the closest point on the plurality of the electrical conductors 300 to the central axis Ax. With this configuration, the electrical conductors 300 are away from the area surrounded by the electrodes 11, thereby allowing the influence of the electrical conductors 300 on the electric field in the area to be reduced or eliminated.

(8) The analytical device according to the present embodiment includes a quadrupole mass filter 10*a*. With this configuration, the analytical device separates ions having desired m/z more accurately, and allows the detectable amount of the ions to be increased, and further, the above advantages are exhibited.

(9) In the analytical device according to the present embodiment, the electrical conductors 300 are grounded. This configuration allows the influence of the ions entering the electrical conductors 300 on the electric field in the area surrounded by the electrodes 11 to be reduced or eliminated.

The following Variations are also within the scope of the present invention and can be combined with the embodiment described above. In the following Variations, parts having the same structures or functions as those of the above-mentioned embodiment are denoted by the same reference numerals, and the descriptions of the parts are omitted as appropriate.

Variation 1

In the embodiment described above, the electrical conductors 300 are grounded, but may be configured such that a voltage applied to the electrical conductors 300 can be controlled.

Figure 5:
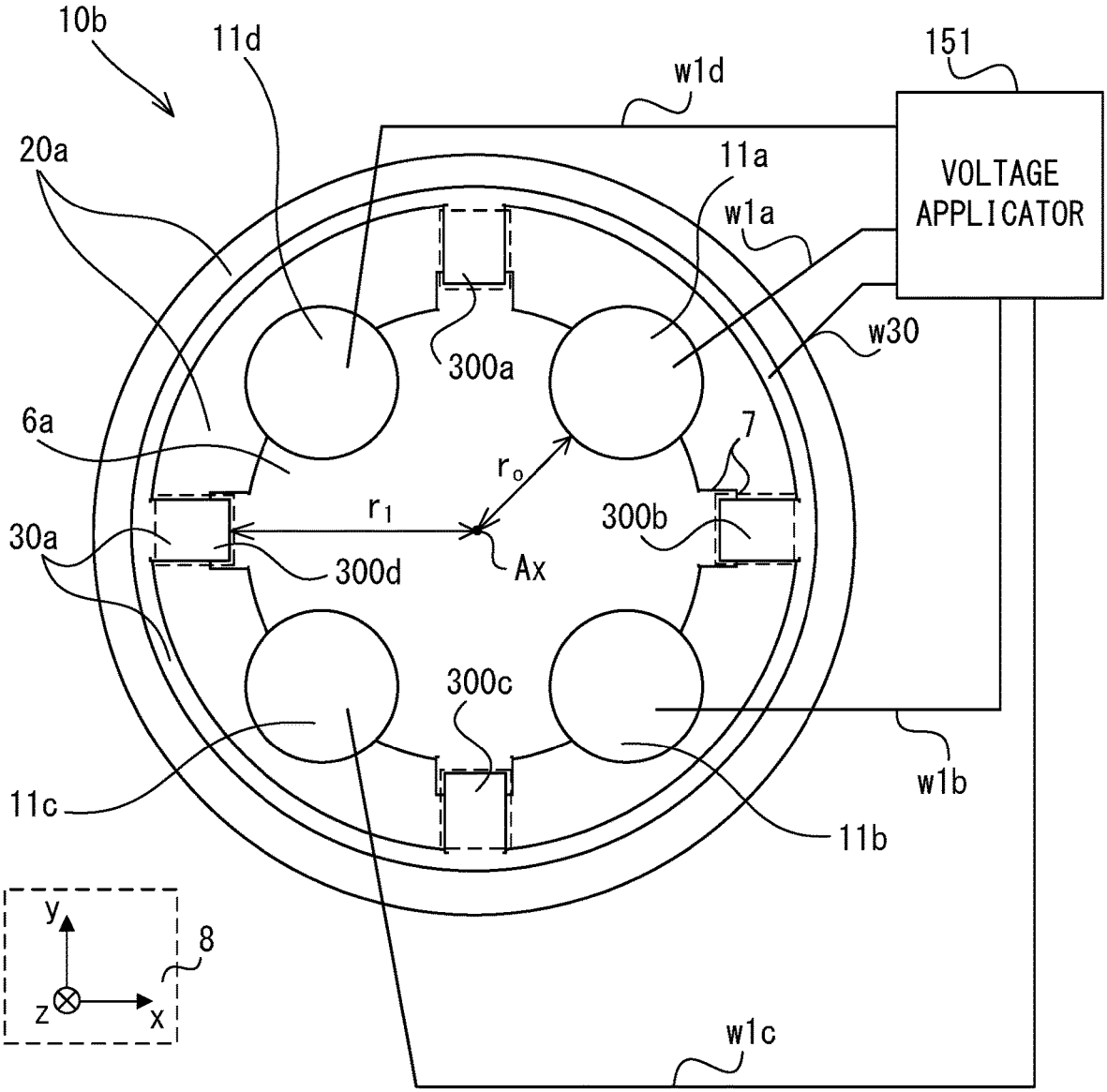
FIG. 5 is a schematic front view of a configuration of a quadrupole mass filter of a Variation.

FIG. 5 is a schematic front view of the shape of the quadrupole mass filter 10*b* of this Variation. The quadrupole mass filter 10*b* has substantially the same configuration as the quadrupole mass filter 10*a*. The quadrupole mass filter 10*b* is different from the quadrupole mass filter 10*a* in that the quadrupole mass filter 10*b* includes wiring for applying a voltage to the electrical conductors 300, the conductive structure 30*a*, i.e., the electrical conductors 300 and the voltage applicator 151 are electrically connected to each other, and the voltage applicator 151 applies a voltage to the electrical conductors 300*a*, 300*b*, 300*c*, and 300*d*. The electrical connection between the conductive structure 30*a* and the voltage applicator 151 is schematically shown by a polygonal line w30.

Figure 6:
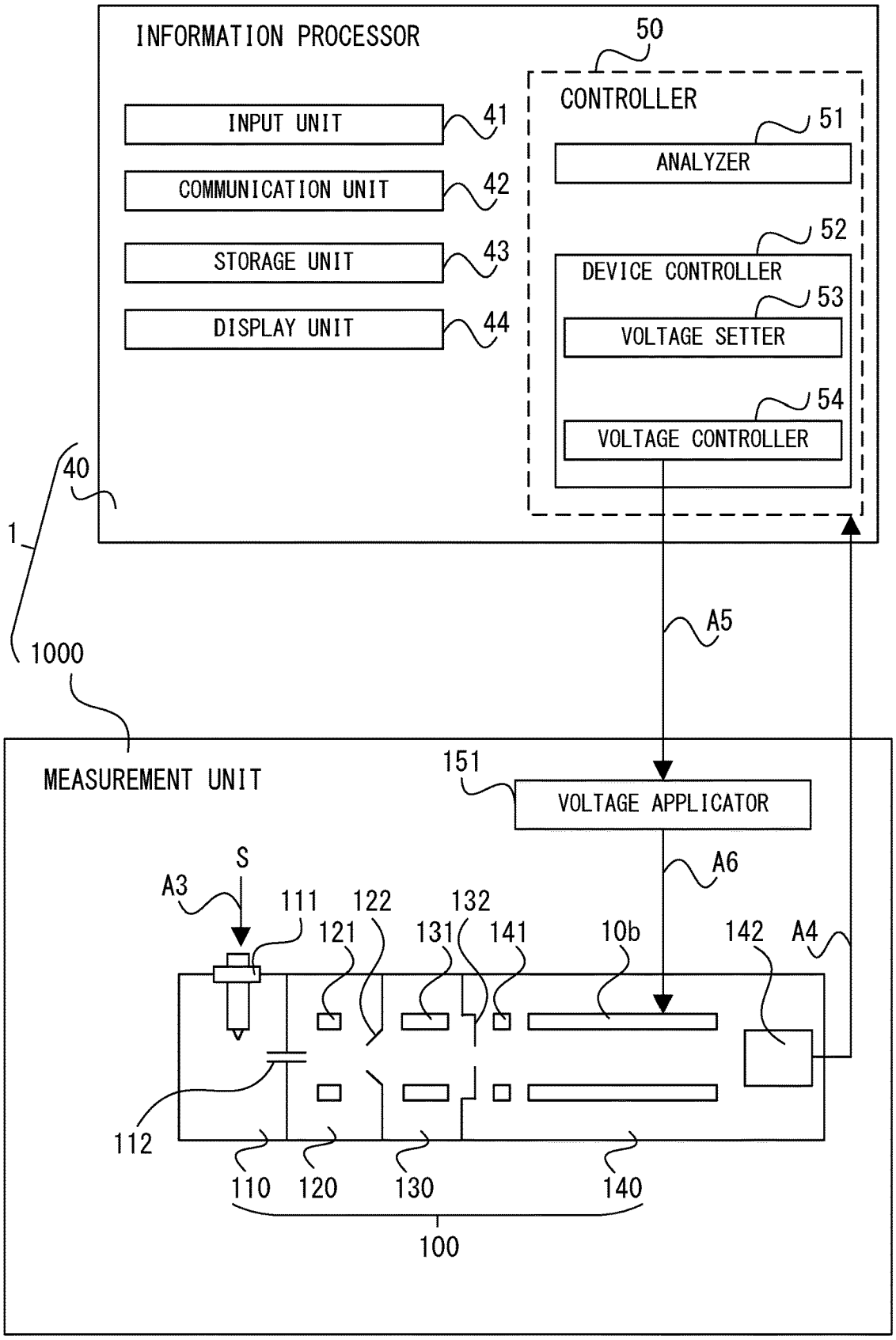
FIG. 6 is a conceptual diagram illustrating a configuration of an analytical device.

FIG. 6 is a conceptual diagram illustrating a configuration of an analytical device 1 including the quadrupole mass filter 10*b* of the present Variation. The analytical device 1 includes an information processor 40 and a measurement unit 1000.

The information processor 40 includes an input unit 41, a communication unit 42, a storage unit 43, a display unit 44, and a controller 50. The controller 50 includes an analyzer 51 and a device controller 52. The device controller 52 includes a voltage setter 53 and a voltage controller 54.

The measurement unit 1000 includes a mass separator 100 and a voltage applicator 151. The mass separator 100 includes an ionization chamber 110, a first vacuum chamber 120, a second vacuum chamber 130, and a third vacuum chamber 140. The ionization chamber 110 includes a sample introduction portion 111 to which a sample S is introduced. The first vacuum chamber 120 includes an ion lens 121. The second vacuum chamber 130 includes an ion guide 131. The third vacuum chamber 140 includes a pre-quadrupole mass filter 141, a quadrupole mass filter 10*b*, and a detector 142. The ionization chamber 110 has a substantially atmospheric internal pressure, and the internal pressures of the first vacuum chamber 120, the second vacuum chamber 130, and the third vacuum chamber 140 are gradually lowered in this order. The third vacuum chamber 140 is in a high vacuum such as $10^{-2}$ Pa or less.

The sample introduction portion 111 introduces a sample S into the ionization chamber 110 (arrow A3). The sample introduction portion 111 includes an electrospray (ESI) probe which functions as an ionizer, and the ESI probe applies a high voltage to a liquid containing the sample S to spray the liquid, thereby generating droplets of the charging liquid. The droplets of the charging liquid move toward the capillary 112 which is placed between the ionization chamber 110 and the first vacuum chamber 120 and to which a voltage for attracting ions is being applied. During the movement, a solvent is removed, thereby generating sample-derived ions. Ions passing through the capillary 112 are introduced into a first vacuum chamber 120.

The ions introduced into the first vacuum chamber 120 are converged by an ion lens 121, passed through a skimmer 122, and then introduced into a second vacuum chamber 130. The ions introduced into the second vacuum chamber 130 are converged by an ion guide 131, passed through an aperture electrode 132, and then introduced into a third vacuum chamber 140.

The ions introduced into the third vacuum chamber are converged by a pre-quadrupole mass filter 141 including a quadrupole mass filter, and then introduced into a quadrupole mass filter 10*b*. The ions introduced into the quadrupole mass filter 10*b* are electromagnetically affected by a voltage applied from the voltage applicator 151 to the electrodes 11, and ions having predetermined m/z selectively pass through the quadrupole mass filter 10*b*. As will be described later, in the quadrupole mass filter 10*b*, the voltage applicator 151 controls a voltage for the electrical conductors 300, thereby allowing the measurement with high accuracy. The ions passing through the quadrupole mass filter 10*b* enter the detector 142.

The electrical conductors 300 may be arranged in the pre-quadrupole mass filter 141.

The detector 142 includes an ion detector such as a secondary electron multiplier, and detects ions passed through the quadrupole mass filter 10*b*. Detection signals including detected ion intensities are A/D converted by an A/D converter (not shown), and then output as measurement data to the controller 50 (arrow A4).

It should be noted that the configuration of the mass separator 100 is not particularly limited as long as the ionized sample S is separated using the quadrupole mass filter 10*b*.

The information processor 40 includes information processing device such as a computer, becomes an interface with a user, as appropriate, and performs processing of communication, storage, calculation and the like, regarding various data.

It should be noted that the information processor 40 may be arranged at a position physically apart from the measurement unit 1000. Some of the data used by the information processor 40 may be stored on a remote server or the like, and some of the arithmetic processing conducted by the information processor 40 may be conducted by a remote server or the like.

The input unit 41 of the information processor 40 is constituted by an input device such as a mouse, a keyboard, various buttons, and/or a touch panel. The input unit 41 receives information on the measurement conditions such as values of m/z of ions to be detected, information necessary for processing conducted by the controller 50, and other information from the user.

The communication unit 42 of the information processor 40 is constituted by a communication device capable of communicating wirelessly or by wire via a network such as the Internet. The communication unit 42 transmits and receives necessary data appropriately. For example, the communication unit 42 receives data necessary for measurement conducted by the measurement unit 1000, transmits data processed by the controller 50 such as analysis results by the controller 50.

The storage unit 43 of the information processor 40 includes a nonvolatile storage medium. The storage unit 43 stores data indicating a change in voltage applied by the voltage applicator 151 over time, measurement data output from the measurement unit 1000, data on the analysis results by the controller 50, programs for executing processing by the processing unit 50, and the like.

The display unit 44 of the information processor 40 includes a display device such as a liquid crystal monitor, and displays the information on analysis conditions, measurement data, analysis results, and the like on the display device.

The controller 50 of the information processor 40 includes a processor such as CPU. The controller 50 conducts various kinds of processing by executing programs stored in the storage unit 43 or the like, such as control of operations of the sections in the measurement unit 1000 and analysis of measurement data output from the measurement unit 1000.

The analyzer 51 creates, from detection intensities in the detection signals detected by the detector 142 and the set value of m/z at which ions are selectively separated by the mass separator 100 when the detection intensities are obtained, mass spectrum data in which each m/z corresponds to each of the detection intensities.

The analyzer 51 calculates the detection amount of ions derived from the sample from the intensity of the peak corresponding to the m/z value of the ions in the mass spectrum. The analyzer 51 conducts, for example, processing of increasing quantitativeness such as smoothing of the mass spectrum data, and then acquires the maximum intensity or the area of the peak corresponding to the ions derived from the sample, which are regarded as the detection amount of the ions.

It should be noted that the analyzer 51 is capable of conducting various analyses in addition to the creation of data for mass spectra.

The device controller 52 of the controller 50 controls operations of the sections in the measurement unit 1000 based on the measurement conditions set based on the input from the input unit 41 or the like. Hereinafter, an example of controlling voltages for the electrical conductors 300 in the quadrupole mass filter 10*b* by controlling the voltage applicator 151 with the device controller 53 in Selected Ion Monitoring (hereinafter referred to as SIM) will be described below.

The voltage setter 53 sets voltages applied from the voltage applicator 151 to the electrodes 11 and the electrical conductors 300 during the dwell time and the pause time during measurement based on the value of m/z for ions to be detected by mass separation input by a user of the analytical device 1 (hereinafter merely referred to as the "user").

Figure 7A:
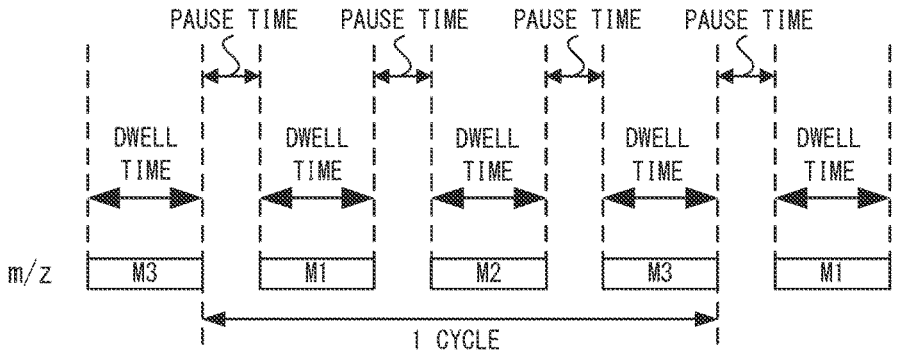
FIG. 7(A) is a conceptual diagram explaining dwell time and pause time.

FIG. 7(A) is a conceptual diagram explaining dwell time and pause time. In the SIM, the predetermined number of ions are selectively detected based on the m/z values. FIG. 7(A) shows an example of the case in which three kinds of ions are detected. The m/z values for the three kinds of ions are M1, M2, and M3.

The dwell time is time for detecting each kind of ions by the detector 142 and taking measurement data in. For example, ions detected by the detector 142 during the dwell time for ions corresponding to M1 are analyzed based on having a value of m/z within the error range from M1. When three kinds of ions are detected, one cycle includes three dwell times and corresponding pause times. When the analytical device 1 analyzes the sample S from the chromatograph, the detection amount of ions in the retention time corresponding to each cycle can be measured by repeatedly performing this cycle.

The pause time is a measurement preparation period provided between the dwell time and the dwell time to, for example, switch the voltage to be applied. The ion signal detected by the detector 142 during the pause time is an ion signal with the applied voltage being transient, and this is not used as significant measurement data. That is, the pause time is time when the measurement is not substantially performed. The voltage applicator 151 applies a voltage so that the voltages of the electrodes 11 becomes voltages to be set after the switching within the pause time.

The voltage setter 53 sets a voltage to be applied to the electrodes 11 based on the value of m/z input by the user, and further set the dwell time and the pause time based on the number of ions to be measured inputted by the user. It is preferred that the storage unit 43 of the analytical device stores data in which values of m/z and voltages applied according to the values are associated, and the voltage setter 53 sets a voltage corresponding to m/z with reference to the data. The voltage setter 53 may set values predetermined in advance from data stored in the storage unit 43 as the dwell time and the pause time. Also, when the number of ions to be measured is large, the voltage setter 53 may set the pause time and the dwell time shortened within a range where measurement accuracy is acceptable, for example.

It should be noted that the voltage setter 53 may set values input by the user as the dwell time and the pause time.

The voltage setter 53 sets a change in voltage to be applied to the electrical conductors 300 over time based on the set dwell time and pause time. The following shows an example of detecting positive ions, but when negative ions are to be detected, a polarity of the voltage to be set may be reversed from that in the case of positive ions.

Figure 7B:
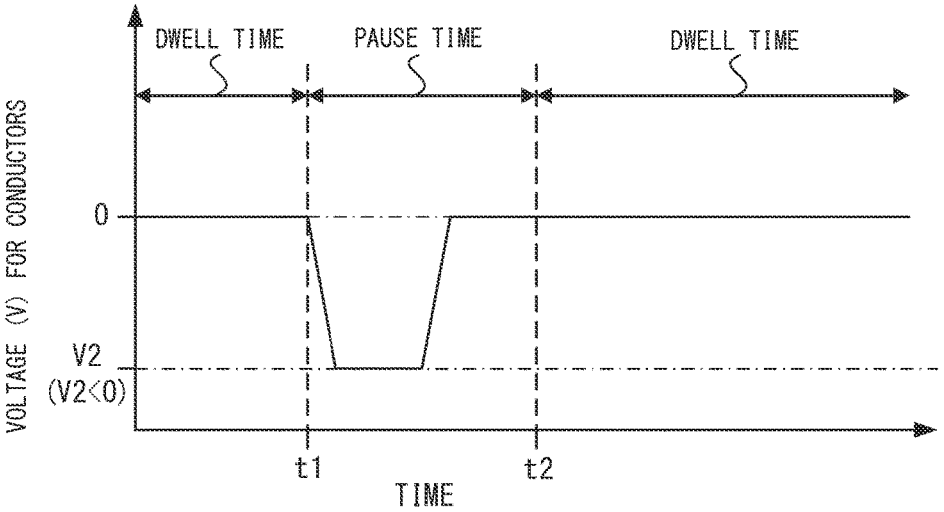
FIGS. 7(B) and 7(C) are conceptual diagrams illustrating a change in a voltage applied to an electrical conductor with time.

FIG. 7(B) is a graph showing an example of a change in voltage to be applied to the electrical conductors 300 over time, set by the voltage setter 53. During the dwell time, if a voltage of the electrical conductors 300 becomes a value which is different from 0, the electric field in the area surrounded by the electrodes 11 will be disturbed, thereby reducing the measurement accuracy. Thus, the voltage setter 53 sets a voltage for the electrical conductors 300 to zero.

The voltage setter 53 applies a voltage having a different polarity from the ions to be detected, to the electrical conductors 300 during the pause time. In the example of FIG. 7(B), the detector 142 detects positive ions, and thus, a negative voltage is applied to the electrical conductors 300 during the pause time. This application attracts ions to the electrical conductors 300, thereby allowing avoidance of charging of the holder 20*a* caused by collision of the ions with the holder 20*a* or the like during the pause time.

Figure 7C:
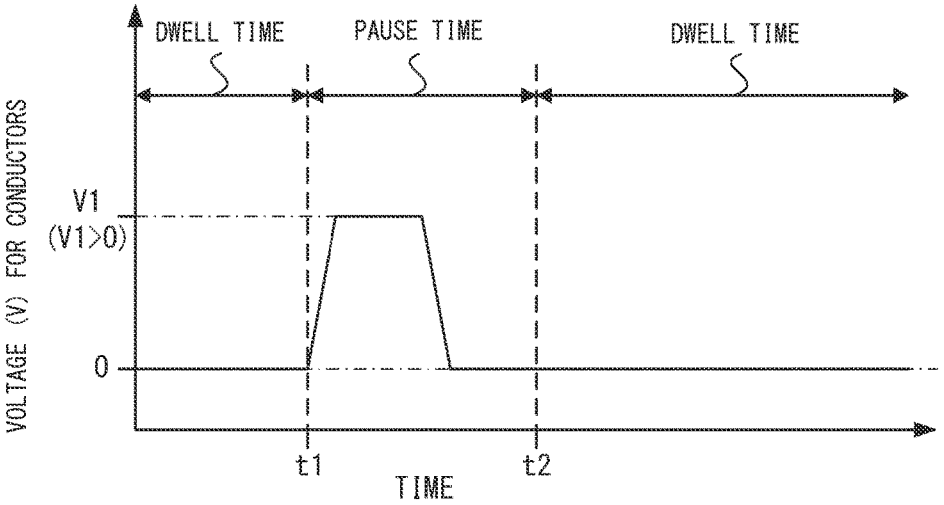

FIG. 7(C) is a graph showing another example of a change in voltage to be applied to the electrical conductors 300 over time, set by the voltage setter 53. In this case, the voltage setter 53 applies a voltage having the same polarity as the ions to be detected, to the electrical conductors 300 during the pause time. In the example of FIG. 7(C), the detector 142 detects positive ions, and thus, a positive voltage is applied to the electrical conductors 300 during the pause time. This application removes ions collided with foreign matters that have been adhered to the electrical conductors 300 and caused charging, thereby allowing charging of the electrical conductors 300 to be reduced or eliminated.

The voltage controller 54 controls the voltage applicator 151 and cause the voltage applicator 151 to apply a voltage based on the change in voltage applied to the electrodes 11 over time and the change in voltage applied to the electrical conductors 300 over time, set by the voltage setter 53 (FIG. 6, arrow A5). The voltage applicator 151 includes a power source capable of applying a direct-current voltage and an alternating-current voltage, and applies a voltage obtained by superimposing the direct-current voltage and the alternating-current voltage to the electrodes 11 and applies the direct-current voltage to the electrical conductors 300 (arrow A6).

It should be noted that the power source may be divided into a power supply that applies a voltage to the electrodes 11 and a power supply that supplies a voltage to the electrical conductors 300, and the power supply that applies a voltage to the electrical conductors 300 may be constituted as a direct-current power supply.

Figure 8:
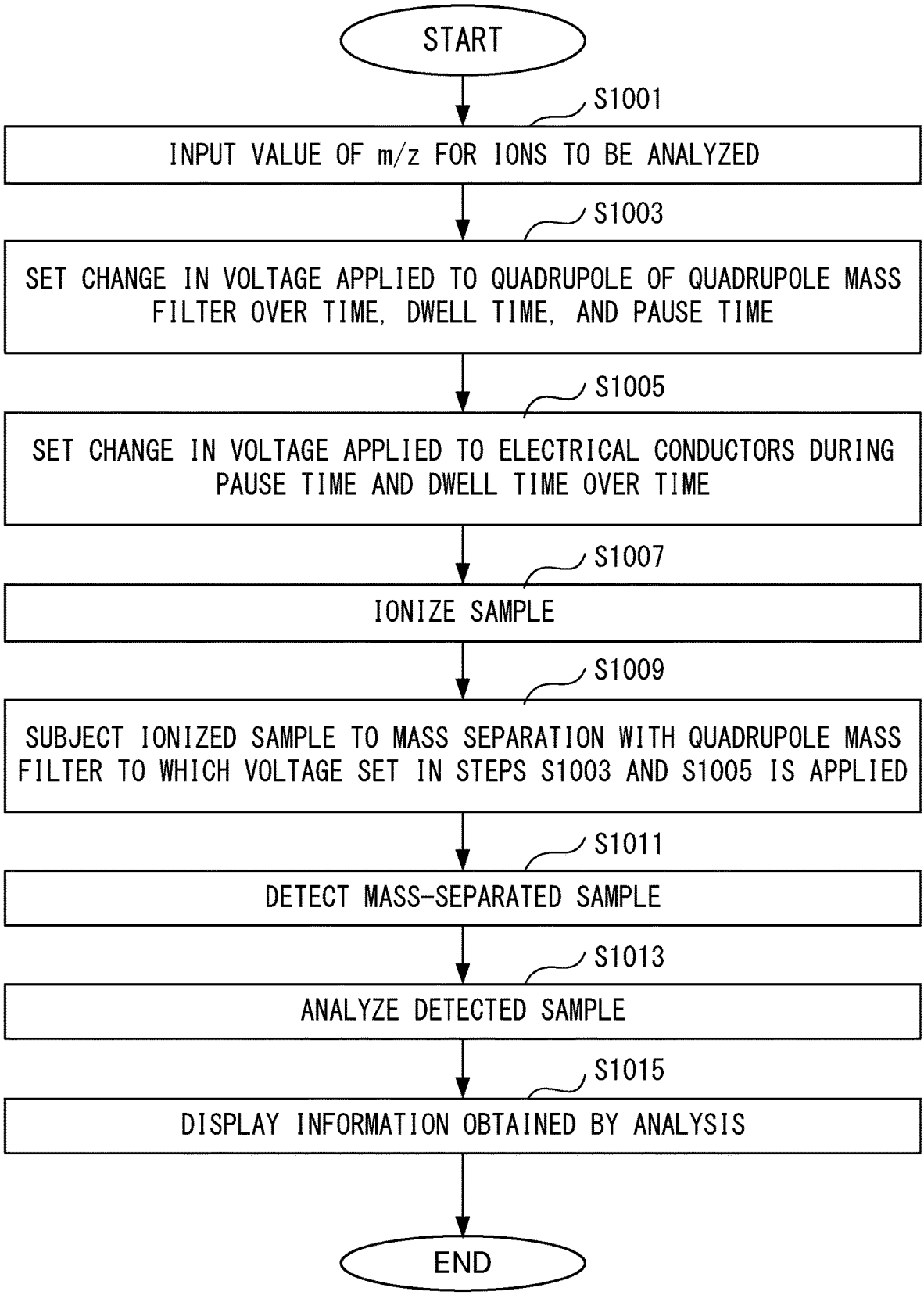
FIG. 8 is a flowchart illustrating flow of an analysis method according to a Variation.

FIG. 8 is a flowchart illustrating flow of an analysis method according to the present embodiment. In step S1001, a user inputs a value of m/z for ions to be analyzed. After the step S1001, the step S1003 is started. In the step S1003, the voltage setter 53 sets a change in voltage applied to a quadrupole of the quadrupole mass filter 10*b* over time, and dwell time and pause time. After the step S1003, the step S1005 is started.

In the step S1005, the voltage setter 53 sets a change over time in voltage applied to the electrical conductors 300 during the pause time and the dwell time. After the step S1005, the step S1007 is started. In the step S1007, a mass separation unit 100 ionizes the sample S. After the step S1007, the step S1009 is started.

In the step S1009, the mass separation unit 100 subjects the ionized sample S to mass separation with a quadrupole mass filter 10*b* to which a voltage set in the steps S1003 and S1005 is applied. After the step S1009, the step S1011 is started. In the step S1011, a detection unit 142 detects the mass-separated sample S. After the step S1011, the step S1013 is started.

In the step S1013, an analyzer 51 analyzes the detected sample S. After the step S1013, the step S1015 is started. In the step S1015, a display unit 44 displays information obtained in the analysis performed in the step S1013. After the step S1015, the process is completed.

It should be noted that the present Variation shows an example of changing a voltage for the electrical conductors 300 during the pause time of SIM, but a voltage for the electrical conductors 300 may be changed at any time when no substantive measurement is being performed without particular limitations. For example, in the tandem quadrupole mass spectrometer, a quadrupole mass filter 10*b* can be used as a quadrupole mass filter for the early stage and/or a quadrupole mass filter for the later stage. A voltage may be applied to the electrical conductors 300 in the quadrupole mass filter 10*b* for the early stage and/or the later stage during the pause time of Multiple Reaction Monitoring (MRM) where ions selectively passed through with the quadrupole mass filter in the early stage are dissociated, and, among the dissociated ions, specific ions passed through the quadrupole mass filter in the later stage are detected. Such a case also allows avoidance of the charging of the holder 20*a* suitably.

By the above Variation, the following actions and effects can be obtained in addition to the actions and effects obtained in the first embodiment.

(1) The quadrupole mass filter 10*b* of the present Variation includes wiring for applying a voltage to the electrical conductors 300. This configuration allows a voltage of the electrical conductors 300 to change, and allows ions which cause charging to be moved, thereby allowing avoidance of charging in the quadrupole mass filter 10*b*. This avoidance allows the measurement accuracy to be increased.

(2) The analytical device 1 according to the present Variation includes a detector 142 that detects ions passed through the quadrupole mass filter 10*b*, and a voltage applicator 151 applies a voltage having a polarity different from that of the ions to the electrical conductors 300 during a measurement preparation period between a first measurement period when the detector 142 detects a first analyte and a second measurement period when the detector 142 detects a second analyte, the measurement preparation period being when no measurement is performed. This application attracts ions which cause charging of the electrical conductors 300, thereby allowing avoidance of charging of the quadrupole mass filter 10*b*. This avoidance allows the measurement accuracy to be increased.

(3) In the analytical device 1 according to the present Variation, the voltage applicator 151 applies a voltage having the same polarity as that of the ions to the electrical conductors 300 during the above measurement preparation period of the detector 142. This application allows avoidance of charging in the electrical conductors 300, thereby allowing measurement accuracy to be increased.

(4) The analytical device 1 according to the present Variation includes a voltage applicator 151 that applies a voltage to the electrical conductors 300. This configuration allows a voltage of the electrical conductors 300 to change, and allows ions which cause charging to be moved, thereby allowing avoidance of charging in the quadrupole mass filter 10*b*. This avoidance allows the measurement accuracy to be increased.

Variation 2

In the embodiment, the holder 20*a* is configured to hold the electrical conductor 300 using elasticity of the material constituting the electrical conductor 300, but the electrical conductor 300 may be fixed by combining the use of elasticity with screwing, or by screwing without using elasticity. Even in such a case, the attachment portion 7 is in a groove-like shape with which electrical conductor 300 is positioned easily, thereby allowing rapid attachment of the electrical conductor 300.

Variation 3

In the above embodiment, the electrical conductors 300 are provided in each of the holders 20*a* and 20*z*, but the electrical conductor 300 may extend from the holder 20*a* to the holder 20*z* to be integrated along the central axis Ax. Even in such a case, the attachment portion 7 is in a groove-like shape with which electrical conductor 300 is positioned easily, thereby allowing rapid attachment of the electrical conductor 300. Further, the electrical conductor 300 extends between the holders 20*a* and 20*z*, thereby allowing the ions deviated from the central axis Ax to be efficiently taken in.

In this case, the electrical conductors 300*a*, 300*b*, 300*c*, and 300*d* may not be integral with each other.

Second Embodiment

A quadrupole mass filter 10*c* according to the second embodiment has the same configuration as the quadrupole mass filter 10*a* according to the first embodiment except that the configuration of each of the electrical conductors is different from that of the first embodiment. The identical parts to those of the first embodiment are denoted by the same reference numerals, and the descriptions thereof are omitted as appropriate.

Figure 9A:
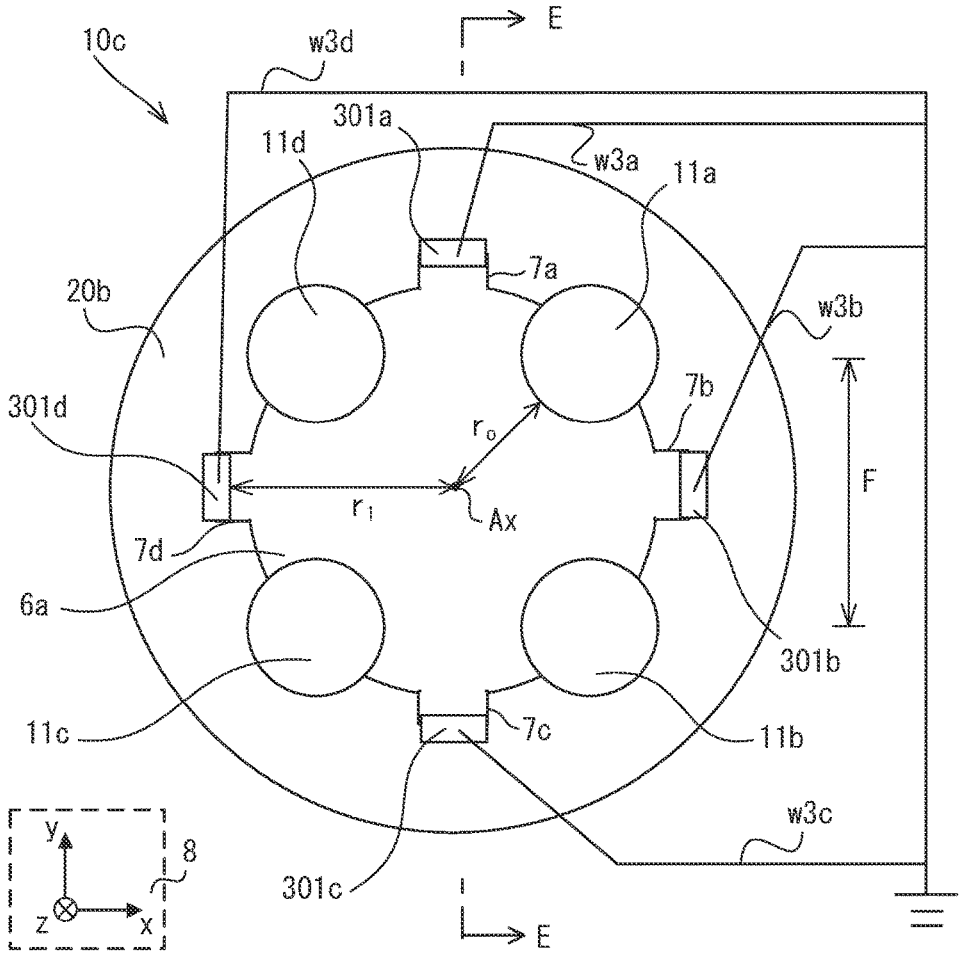
FIG. 9(A) is a schematic front view of a configuration of a quadrupole mass filter according to an embodiment.
Figure 9B:
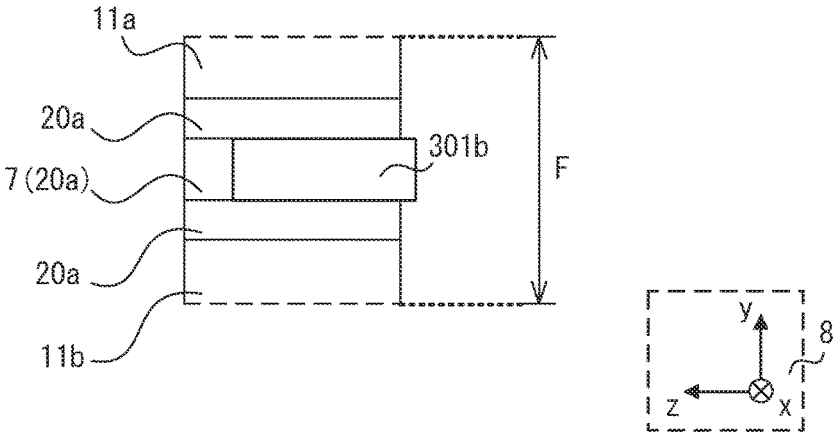
FIG. 9(B) is an E-E cross-sectional view of FIG. 9(A).

FIGS. 9(A) and 9(B) are conceptual diagrams illustrating the quadrupole mass filter 10*c* according to the present embodiment. FIG. 9(A) is a front view, FIG. 9(B) is an E-E cross-sectional view of an area indicated by Win FIGS. 1(B) and F in FIG. 9(A).

The quadrupole mass filter 10*c* includes a holder 20*b*, electrodes 11 held by the holder 20*b*, and electrical conductors 301*a*, 301*b*, 301*c*, and 301*d*. The four electrical conductors 301*a*, 301*b*, 301*c*, and 301*d* are arranged at respective positions to be four-fold symmetrical with the central axis Ax serving as a rotation axis. The electrical conductors 301*a*, 301*b*, 301*c*, and 301*d* are not integral with each other unlike the electrical conductors 300 in the embodiment, and are arranged in the respective attachment portions 7*a*, 7*b*, 7*c*, and 7*d*. The grounding of the electrical conductors 301*a*, 301*b*, 301*c*, and 301*d* is schematically shown by polygonal lines w3*a*, w3*b*, w3*c*, and w3*d*.

As shown in FIG. 9(B), the electrical conductor 301*b* is configured such that, as viewed from the hollow portion 6*a* of the holder 20*b*, its plate-like portion having electrical conductivity is arranged along the attachment portion 7*b* which is a groove-like recess formed in the inner peripheral surface 21 of the holder 20*b*. The same applies to the electrical conductors 301*a*, 301*c*, and 301*d*.

Figure 10A:
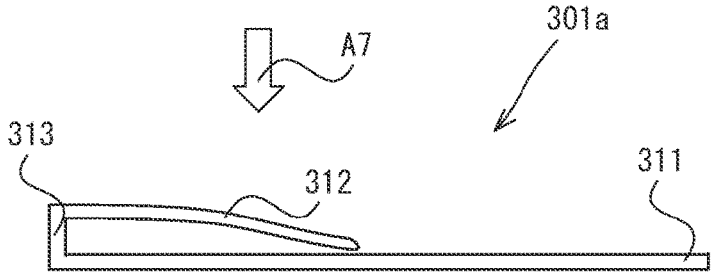
FIGS. 10(A), 10(B), and 10(C) are conceptual diagrams explaining an electrical conductor according to an embodiment.
Figure 10B:
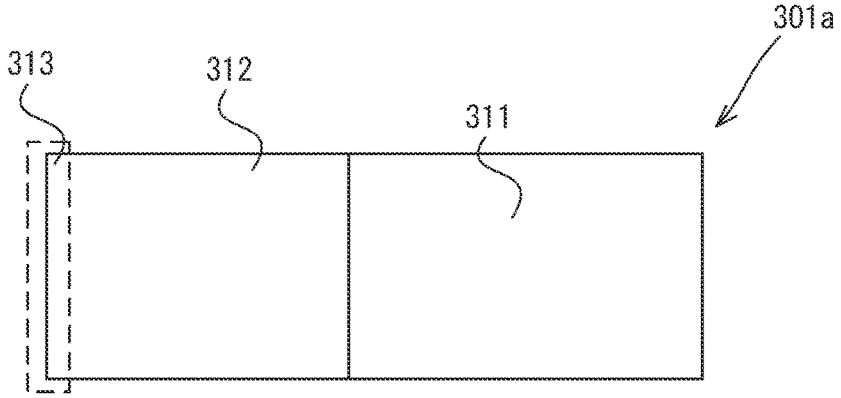
Figure 10C:
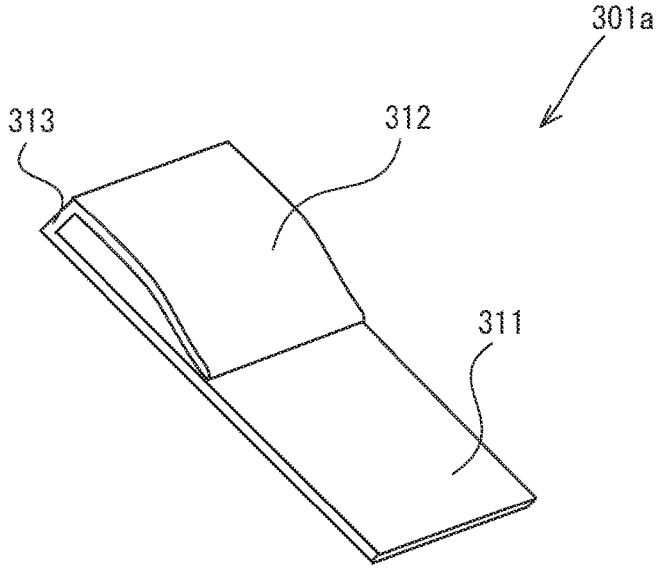
Figure 11:
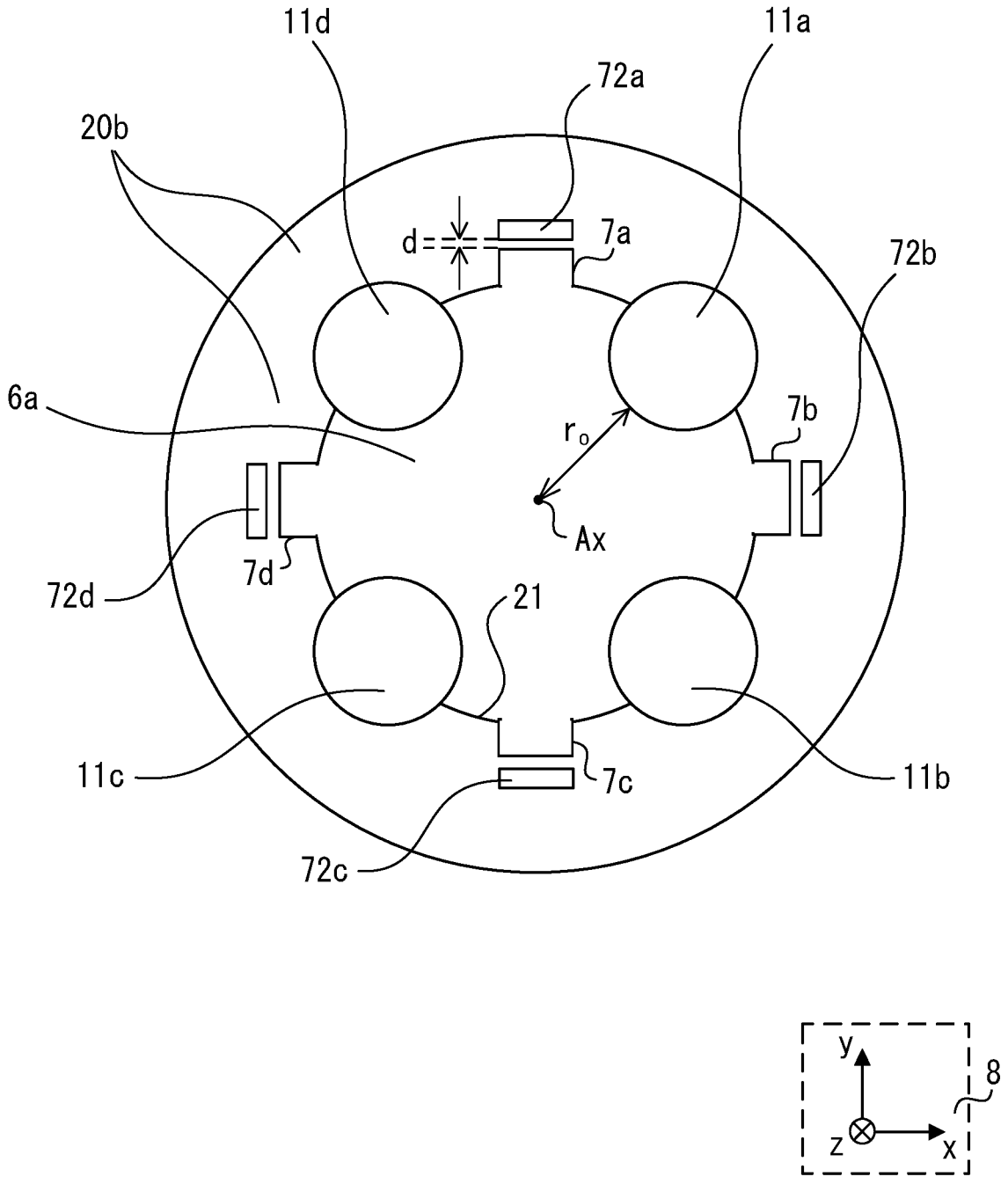
FIG. 11 is a schematic front view of the quadrupole mass filter, illustrating configurations of a quadrupole and a holder.

FIGS. 10(A), 10(B), and 10(C) are conceptual diagrams illustrating a shape of a part constituting the electrical conductor 301*a*. Assuming that the face of the electrical conductor 301 shown in FIG. 9(A) is a front surface, FIG. 10(A) is a side view, FIG. 10(B) is a side view as viewed from the arrow A7 of FIG. 10(A), and FIG. 10(C) is a perspective view. FIG. 11 is a schematic front view of the quadrupole mass filter 10*a*, illustrating the configurations of the quadrupole and the holder 20*b*. The holder 20*b* has a substantially the same configuration as the holder 20*a* of the above embodiment, but is different from the holder 20*a* in that the attachment holes 72*a*, 72*b*, 72*c*, and 72*d* are formed to be substantially parallel with the bottom surfaces of the attachment portions 7*a*, 7*b*, 7*c*, and 7*d*.

The electrical conductor 301*a* is integrally configured by a conducting material having an elastomeric force such as a metal, as appropriate, and includes a flat plate-shaped plate-like member 311, a plate-like member 312, and a connection 313 connecting the plate-like member 311 and the plate-like member 312. The plate-like member 312 is formed such that a portion of the plate-like member 312 close to the connection 313 is substantially parallel with the plate-like member 311, but the gap between the plate-like members 311 and 312 becomes narrower as the plate-like member 312 is apart from the connection 313. The narrowest gap between the plate-like members 311 and 312 is shorter than the gap between the attachment portion 7*a* and the attachment hole 72*a* (see FIG. 11).

The electrical conductor 301*a* is attached by inserting the plate-like member 312 into the attachment hole 72*a* and arranging the plate-like member 311 along the face of the attachment portion 7*a* on the side of hollow portion 6*a*. Here, the narrowest gap between the plate-like members 311 and 312 is shorter than the gap between the attachment portion 7*a* and the attachment hole 72*a* (FIG. 11). Accordingly, a clipping force, which is an elastomeric force caused by the increase in the gap between the plate-like members 311 and 312, is applied to the partition between the attachment portion 7 and the attachment hole 72*a*, and the static frictional force associated with this elastomeric force fixes the electrical conductor 301*a* to the inner peripheral surface 21 of the holder 20*b*. As described above, the plate-like members 311 and 312 and the connection 313 constitute a clip mechanism. The electrical conductors 301*b*, 301*c*, and 301*d* also include the same clip mechanisms. In the quadrupole mass filter 10*c*, a plurality of the electrical conductors 301*a*, 301*b*, 301, and 301*d* are integral with the respective clip mechanisms, and clipped to the attachment portions 7*a*, 7*b*, 7*c*, and 7*d*, respectively by these clip mechanisms and held by the holder 20*b*.

By the second embodiment, the following actions and effects can be obtained in addition to the actions and effects obtained in the first embodiment.

(1) In the quadrupole mass filter 10*c* according to the present embodiment, a plurality of the electrical conductors 301*a*, 301*b*, 301*c*, and 301*d* are integral with the respective clip mechanisms and are clipped to the attachment portions 72*a*, 72*b*, 72*c*, and 72*d*, respectively by these clip mechanisms, and held by the holder 20*b*. This configuration allows the electrical conductors 301*a*, 301*b*, 301*c*, and 301*d* to be positioned and attached rapidly without necessity of operations such as screwing, and allows the quadrupole mass filter 10*a* to be assembled and maintained rapidly. Further, the structures of the electrical conductors 301*a*, 301*b*, 301*c*, and 301*d* are not complex, which makes them highly versatile. Moreover, voltages of the plurality of the electrical conductors 301*a*, 301*b*, 301*c*, and 301*d* can be separately controlled.

Third Embodiment

A quadrupole mass filter 10*d* according to the third embodiment has the same configuration as the quadrupole mass filter 10*c* according to the second embodiment except that the number of electrical conductors arranged is different from that of the second embodiment. The identical parts to those of the second embodiment are denoted by the same reference numerals, and the descriptions thereof are omitted as appropriate.

Figure 12:
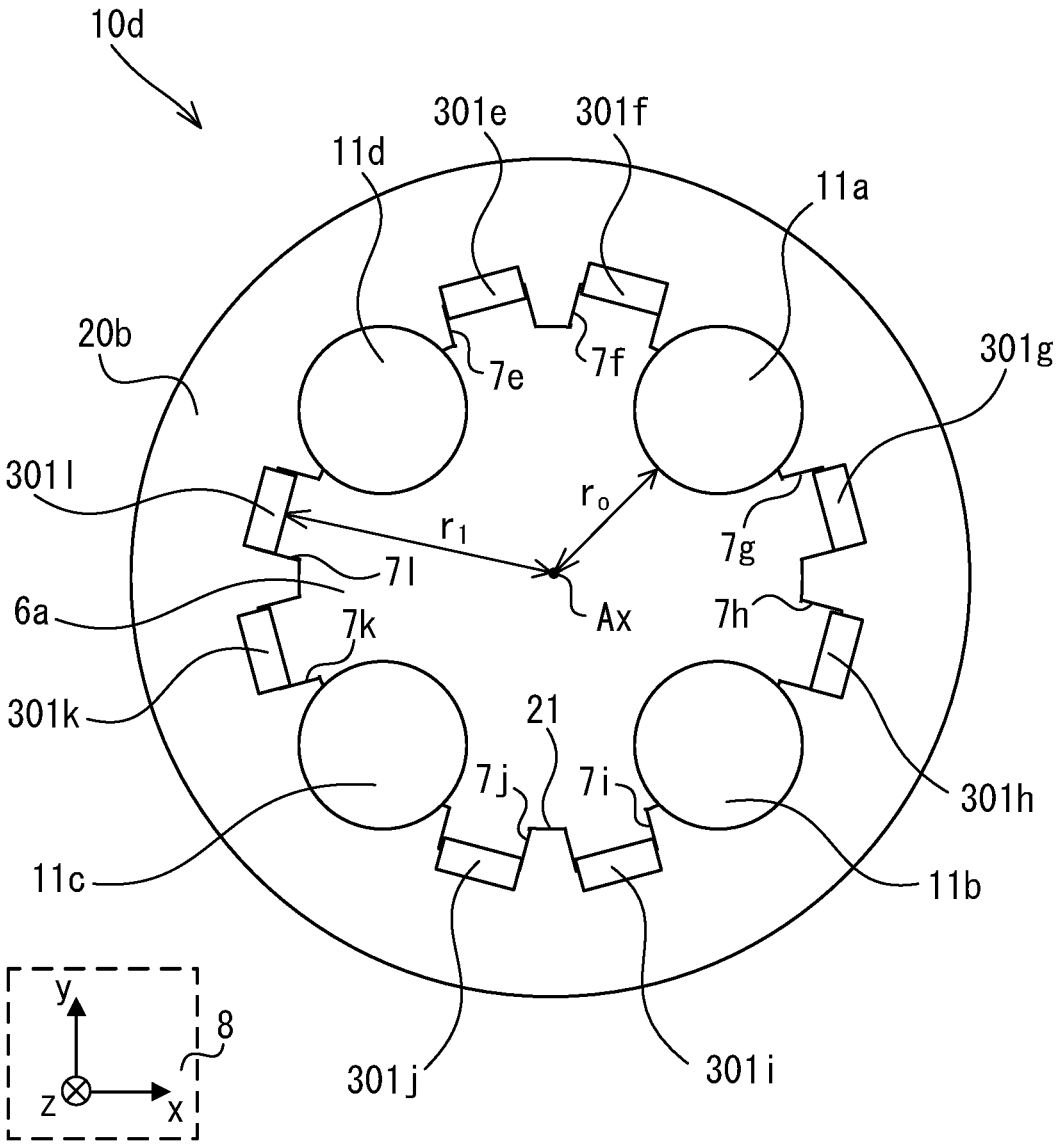
FIG. 12 is a schematic front view of a configuration of a quadrupole mass filter of one embodiment.
Figure 13A:
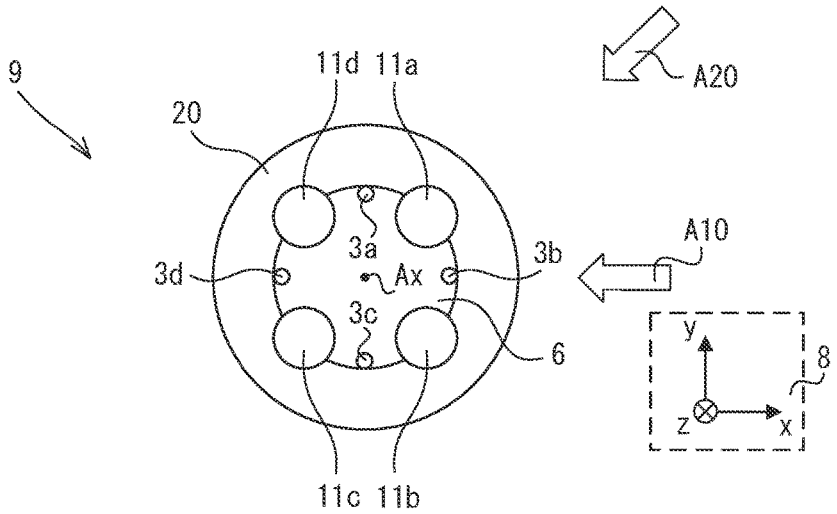
FIGS. 13(A), 13(B), and 13(C) are conceptual diagrams illustrating a configuration of a typical quadrupole mass filter.
Figure 13B:
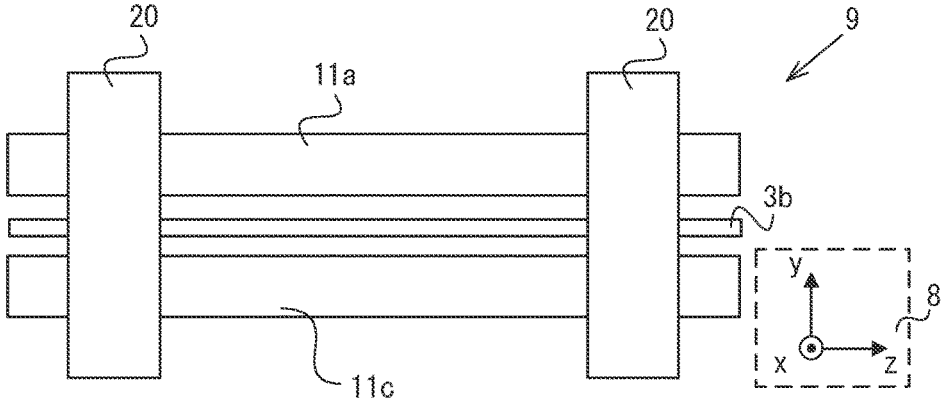
Figure 13C:
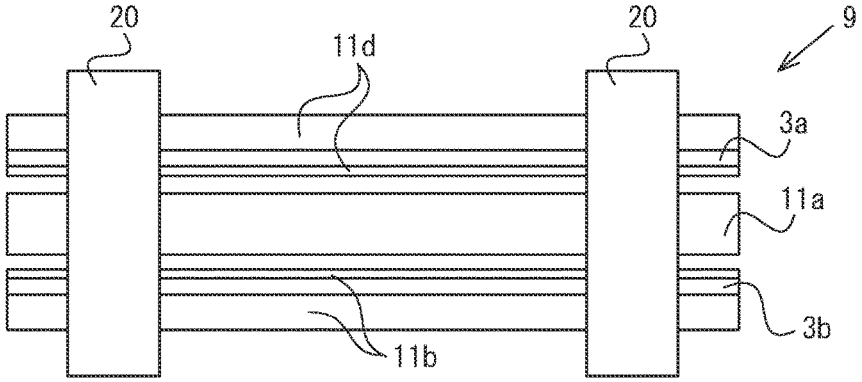

FIG. 12 is a schematic front view of a quadrupole mass filter 10*d* according to the present embodiment. The quadrupole mass filter 10*d* includes electrical conductors 301*e*, 301*f*, 301*g*, 301*h*, 301*i*, 301*j*, 301*k*, and 301*l*. The four electrical conductors 301*e*, 301*g*, 301*i*, and 301*k* are arranged at respective positions to be four-fold symmetrical with the central axis Ax as a rotation axis. The four electrical conductors 301*f*, 301*h*, 301*j*, and 301*l* are arranged at respective positions to be four-fold symmetrical with the central axis Ax as a rotation axis. The electrical conductors 301*e*, 301*f*, 301*g*, 301*h*, 301*i*, 301*j*, 301*k*, and 301*l* are arranged at attachment portions 7*e*, 7*f*, 7*g*, 7*h*, 7*i*, 7*j*, 7*k*, and 7*l*, respectively. The electrical conductors 301*e*, 301*f*, 301*g*, 301*h*, 301*i*, 301*j*, 301*k*, 301*l* are grounded by wiring (not shown), but a voltage may be applied thereto by the above voltage applicator.

Electrical conductors 301*e* and 301*f* are arranged at respective positions that lie in directions toward an area between the adjacent electrodes 11*d* and 11*a* as viewed from the central axis Ax. Electrical conductors 301*g* and 301*h* are arranged at respective positions that lie in directions toward an area between the adjacent electrodes 11*a* and 11*b* as viewed from the central axis Ax. Electrical conductors 301*i* and 301*j* are arranged at respective positions that lie in directions toward an area between the adjacent electrodes 11*b* and 11*c* as viewed from the central axis Ax. Electrical conductors 301*k* and 301*l* are arranged at respective positions that lie in directions toward an area between the adjacent electrodes 11*c* and 11*d* as viewed from the central axis Ax.

As described above, two, i.e., a plurality of electrical conductors among the electrical conductors 301*e*, 301*f*, 301*g*, 301*h*, 301*i*, 301*j*, 301*k*, and 301*l* are arranged at positions that lie in directions toward an area between adjacent electrodes among the four electrodes 11 as viewed from the central axis Ax. In other words, the electrical conductors 301*e*, 301*f*, 301*g*, 301*h*, 301*i*, 301*j*, 301*k*, and 301*l* are arranged at respective positions that lie in radial directions in which the electrodes 11*a*, 11*b*, 11*c*, and 11*d* are not arranged, with the central axis Ax serving as a rotation axis.

The electrical conductors 301*e* and 301*f* are arranged between the electrode 11*d* and the electrode 11*a* adjacent to each other along the inner peripheral surface 21 of the holder 20*b*. The electrical conductor 301*g* and 301*h* are arranged between the electrode 11*a* and the electrode 11*b* adjacent to each other along the inner peripheral surface 21. The electrical conductors 301*g* and 301*h* are arranged between the electrode 11*a* and the electrode 11*b* adjacent to each other along the inner peripheral surface 21. The electrical conductors 301*k* and 301*l* are arranged between the electrode 11*c* and the electrode 11*d* adjacent to each other along the inner peripheral surface 21. In this manner, each two, i.e., a plurality of electrical conductors among the eight electrical conductors 301*e*, 301*f*, 301*g*, 301*h*, 301*i*, 301*j*, 301*k*, and 301*l* are arranged between the electrodes adjacent to each other along the inner peripheral surface 21 among the four electrodes 11.

By the third embodiment, the following actions and effects can be obtained in addition to the actions and effects obtained in the first and second embodiments.

(1) The quadrupole mass filter 10*d* according to the present embodiment includes the electrical conductors 301*e*, 301*f*, 301*g*, 301*h*, 301*i*, 301*j*, 301*k*, and 301*l* among which a plurality of electrical conductors are arranged between each of the adjacent electrodes among the four electrodes 11 as viewed from the central axis Ax. This allows the electrical conductors to be flexibly arranged according to the electric field assumed in the area surrounded by the electrodes 11, and allows the disturbance of the electric field in the area to be reduced or eliminated.

The present invention is not limited by the above embodiments. Other aspects conceivable within the scope of the technical idea of the present invention are encompassed in the scope of the present invention.

REFERENCE SIGNS LIST

1: analytical device; 3*a*, 3*b*, 3*c*, 3*d*: conductive material; 6: typical holder; 6*a*: holder; 7, 7*a*, 7*b*, 7*c*, 7*d*, 7*e*, 7*f*, 7*g*, 7*h*, 7*i*, 7*j*, 7*k*, 7*l*: attachment portion; 9: typical quadrupole mass filter; 10*a*, 10*b*, 10*c*, 10*d*: quadrupole mass filter; 11, 11*a*, 11*b*, 11*c*, 11*d*: electrode; 20: typical holder; 20*a*, 20*b*, 20*z*: holder; 30*a*, 30*z*: conductive structure; 32: annular portion; 40: information processor; 50: controller; 51: analyzer; 52: device controller; 53: voltage setter; 54: voltage controller; 100: mass separator; 142: detector; 150, 151: voltage applicator; 300, 300*a*, 300*b*, 300*c*, 300*d*, 301*a*, 301*b*, 301*c*, 301*d*, 301*e*, 301*f*, 301*g*, 301*h*, 301*i*, 301*j*, 301*k*, 301*l*: electrical conductor; 311, 312: plate-like member; 313: connection; 1000: measurement unit; S: sample

The invention claimed is:

1. A quadrupole mass filter comprising:

four electrodes arranged to surround a central axis and constituting a quadrupole;

attachment portions to which a plurality of electrical conductors are attached, at least one of the electrical conductors being arranged at a position that lies in a direction toward an area between each of the adjacent electrodes among the four electrodes, as viewed from the central axis;

a holder having a hollow portion and holding the four electrodes and the plurality of electrical conductors; and wiring for grounding the electrical conductors or applying a voltage to the electrical conductors, wherein the electrical conductors are attached to the respective attachment portions and held by the holder with elasticity of a material constituting the electrical conductors.

2. The quadrupole mass filter according to claim 1, wherein the attachment portions are formed in the inner peripheral surface facing the hollow portion of the holder to have a recess shape formed by depressing the inner peripheral surface away from the central axis.

3. The quadrupole mass filter according to claim 2, wherein the recess shape in each of the attachment portions is a groove formed in the inner peripheral surface of the hollow portion along the central axis.

4. The quadrupole mass filter according to claim 1, wherein at least portions of the plurality of electrical conductors are connected to and integral with each other by a support.

5. The quadrupole mass filter according to claim 1, wherein each of the plurality of electrical conductors includes a clip mechanism integral therewith and is clipped to each of the attachment portions by the clip mechanism, and held by the holder.

6. The quadrupole mass filter according to claim 1, wherein the attachment portions are arranged at respective positions at which the electrical conductors are at zero potential when respective voltages having the same magnitude and different polarities are applied to the adjacent electrodes.

7. The quadrupole mass filter according to claim 1, wherein a distance from the central axis to a closest point on the plurality of electrical conductors arranged in the respective attachment portions to the central axis is longer than a distance from the central axis to a closest point on the four electrodes to the central axis.

8. An analytical device comprising the quadrupole mass filter according to claim 1.

9. The analytical device according to claim 8, wherein the electrical conductors are grounded.

10. The analytical device according to claim 8, further comprising:

a voltage applicator that applies a voltage to the electrical conductors.

11. The analytical device according to claim 10, further comprising:

a detector that detects ions passed through the quadrupole mass filter, wherein the voltage applicator applies a voltage having a polarity which is the same as or different from that of the ions to the electrical conductors during a measurement preparation period between a first measurement period when the detector detects a first analyte and a second measurement period when the detector detects a second analyte, the measurement preparation period being when no measurement is performed.

* * * * *